United States Patent [19]

Stock et al.

[11] 4,151,983

[45] May 1, 1979

[54] CRANE GRAB APPARATUS

[75] Inventors: Arthur J. Stock, Lakewood; Donald E. Christofer, Willowick; Joseph E. Brinza, Euclid, all of Ohio

[73] Assignee: Stock Equipment Company, Cleveland, Ohio

[21] Appl. No.: 673,465

[22] Filed: Apr. 5, 1976

Related U.S. Application Data

[62] Division of Ser. No. 409,750, Oct. 25, 1973, Pat. No. 3,972,420, which is a division of Ser. No. 182,088, Sep. 20, 1971, Pat. No. 3,835,617.

[51] Int. Cl.[2] ..... B66C 1/00

[52] U.S. Cl. ..... 294/66 A; 294/90

[58] Field of Search ..... 293/83 RA, 86 A, 66 A, 293/90, 104, 88, 86.29; 214/18 N; 176/33, 36 R, 36 C; 254/175

[56] References Cited

U.S. PATENT DOCUMENTS

| | | | |
|---|---|---|---|
| 2,355,086 | 8/1944 | Lang | 294/66 A |
| 3,039,949 | 6/1962 | Newton et al. | 294/86 A |
| 3,190,685 | 6/1965 | Bopp | 294/90 |
| 3,572,808 | 3/1971 | Miller | 294/90 |

*Primary Examiner*—James B. Marbert

*Attorney, Agent, or Firm*—Bosworth, Sessions & McCoy

[57] ABSTRACT

Systems, apparatus and methods are disclosed for disposing of radioactive waste materials by placing them into a container such as a steel drum, together with cement or other solidifying agent and water or other suitable liquid in amount sufficient to provide eventually a solidified mixture of predetermined amounts of cement or other solidifying agent and radioactive material, closing the drum, agitating the mixture in the drum for mixing the contents, and then storing the drum for at least a period of time sufficient to permit partial decay of radioactive materials or to await available time for shipment. Also disclosed are remotely controlled apparatus for handling both empty and filled drums, for placing the drums in and removing drums from enclosed drumming equipment where they have been filled and agitated, for accurately placing the drums containing radioactive material in storage, and for removing the drums from storage and loading them on a vehicle for transportation. All of these operations are done by remote control with a high degree of safety to the operators and maintenance personnel from radiation and freedom of the ambience from radiation pollution.

9 Claims, 40 Drawing Figures

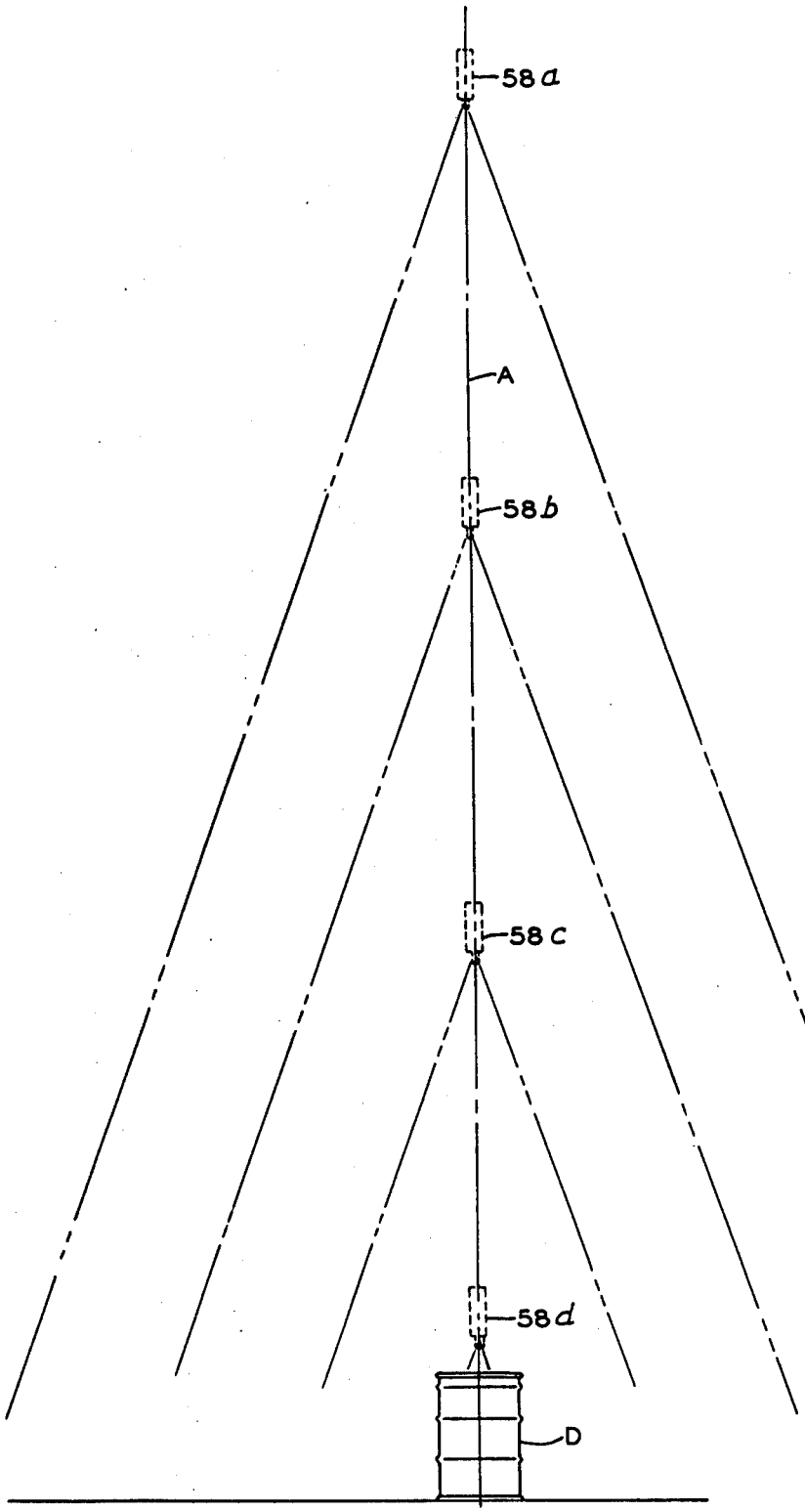
Fig. 23.
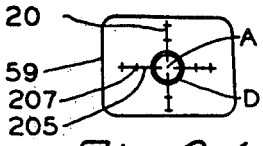
Fig. 24.
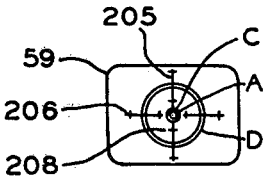
Fig. 25.
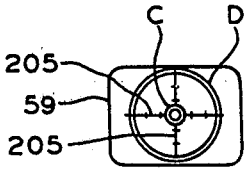
Fig. 26.
Fig. 27.
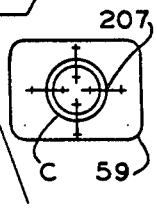

CRANE GRAB APPARATUS

REFERENCE TO RELATED APPLICATION

This is a division of application Ser. No. 409,750 filed Oct. 25, 1973 now U.S. Pat. No. 3,972,420 a division of application Ser. No. 182,088, filed Sept. 20, 1971, now U.S. Pat. No 3,835,617.

BACKGROUND OF THE INVENTION

This invention relates to remotely controlled apparatus for disposition of radioactive waste material as produced, for example, in nuclear electric power generating stations.

Stringent laws, rules and regulations govern the disposition of radioactive wastes and their transportation over highways, on railroads and by other modes of transportation. In general, the material must be shielded so that radiations emanating from the material do not exceed maximum levels established by the laws and regulations. Furthermore, it is desired that in a case of an accident causing dumping of a radioactive load, there should be no fluidic materials that can penetrate the ground or mix with streams or ground water and cause radioactive contamination. It has therefore been proposed to provide a mixture of resin particles containing radioactive material, cement as a solidifying agent, and water in a container such as a steel drum, and to allow the mixture to solidify in the drum.

However, prior systems for putting radioactive materials into a drum or other container in general require that operators and maintenance personnel be exposed to radiation, even though such system may be intended to protect personnel. For example, the operators in many cases must go into areas containing radiation to open drums or close them or to insert nozzles in the drums or to handle the drums in storage. In some systems an operator may stand behind a shield wall, but must extend his arms into a radioactive zone, and expose his head to see, to connect pipes for feeding radioactive material. If spills occur, the operator must go into the radioactive zone to clean up spills. In prior operations where drums are stacked in multiple layers in decay storage areas, the operator must often go into such areas to place planks between the layers. Maintenance men must go into radioactive areas to work on equipment requiring maintenance at intervals, such as conveying equipment, motors, and switches. The total amount of radiation to which personnel can be safely exposed is limited by physiological reasons; therefore, personnel must be controlled as to their duties, and the amount of radiation to which they are exposed frequently checked to avoid their exposure to an excessive amount of radiation that can adversely affect health. Moreover, in operation of the nuclear plant, if an emergency should arise correction of which would require exposure of operators or maintenance men to radiation during a time when all available men had reached their limits of radiation tolerance, a shutdown of the plant might be necessary or other adverse consequences might result because of lack of operators or maintenance men having safe radiation tolerances.

Moreover, prior systems can on occasion spill radioactive materials on the outside of the drums or on the floor. If the spill is on the drum, it is necessary to decontaminate the drum prior to shipment. If the spill is on the floor, then a certain amount of dust can be generated as the material dries. Such, dust, which is radioactive, could find its way through the plant and thus make the plant unsafe because of radioactivity. Spilled materials also can collect in floor drains and clog them. Prior systems for putting radioactive material into drums in general have loaded drums in an open space, so there was no way of containing or taking care of the problems caused by spills of radioactive material.

Some previous systems have numerous operating mechanical parts requiring periodic maintenance, such as motors and electrical switches, in radioactive areas. Maintenance of such equipment can expose personnel to considerable radiation.

Previous equipment loads drums containing radioactive material onto trucks or casks in a haphazard fashion, and thus, not loading the truck or cask to full capacity, would lose lading and could cause damage to the drums or drum enclosure.

Previous systems, because of loss of electrical power or air pressure or improper handling of the drum handling means, could topple a drum or cause irregularities in operation which could cause spillage of radioactive material.

SUMMARY OF THE INVENTION

It is a general object of the present invention to overcome the above and other problems relating to the disposition of radioactive waste materials. A further object is the provision of apparatus and methods for overcoming as many as desired of the above indicated problems, as well as other problems. Another object is to provide apparatus for moving containers into the filling and mixing location, moving the containers into storage and accurately locating them there, moving them out of storage to another location such as on a transportation vehicle and locating them there, and for recovering a container if it should be upset. A further object is to provide apparatus for carrying out such operations by remote control so personnel need not be exposed to radiation during operations and to very little if any radiation during maintenance of equipment. A further object is to provide apparatus for carrying out such operations by remote control so personnel need not be exposed to radiation during operations and to very little if any radiation during maintenance of equipment. A further object is provision of apparatus which can be easily repaired or maintained with little if any exposure of personnel or surrounding environment to hazardous radiation.

To accomplish these and other objects, the present invention provides a special overhead crane apparatus mounted in a building having walls resistant to passage of radioactivity, which walls segregate from locations occupiable by personnel the loction at which the radioactive material is introduced into storage containers and the location at which such containers are stored.

The overhead crane apparatus of this invention comprises a trolley controlled from a remote location, means for supporting the trolley for transverse movement to a variety of different locations, indicia means designating fixed locations directly above the containers at which the trolley is to be located, a television camera mounted on the trolley and adapted to view said indicia means, monitor means at said remote location to determine when the trolley is properly located, grab means suspended from the trolley by cables, hoist means for raising and lowering the cables, a downwardly facing television camera carried by the grab means for viewing the top of the containers to be lifted, and television monitor means at said remote location for viewing the scene viewed by said downwardly facing camera. The latter camera has indicia at its lens which when compared with markings on the container top enable the operator to determine the distance between the grab means and said container top as the grasping means approaches the container.

When handling circular drums, the grab means are provided with a series of special gripping means for grasping the top circumferential edge portions of the drum at circumferentially spaced locations. Such gripping means preferably comprises pivoted fingers which can swing radially outwardly to accommodate variations in the shape of the drums. The grab means has a rotatably mounted subframe supporting the gripping means so that the angular position of the gripping means can be adjusted. The equipment is constructed to facilitate retrieval of drums which have accidently been tilted or moved to a horizontal position, and a procedure is provided for gripping one edge of the drum to return the drum to its vertical position.

BRIEF DESCRIPTION OF THE DRAWINGS

These and other objects and features of the invention will be apparent from the following description of a preferred embodiment of the invention in connection with the accompanying drawings in which:

FIGS. 23 to 27 inclusive show how the television camera on the grab can be used to locate the height of the grab above a drum, FIGS. 24 to 27 inclusive particularly showing the view on the television monitor screen;

DISCLOSURE OF PREFERRED EMBODIMENT

General Arrangement

Figure 1:
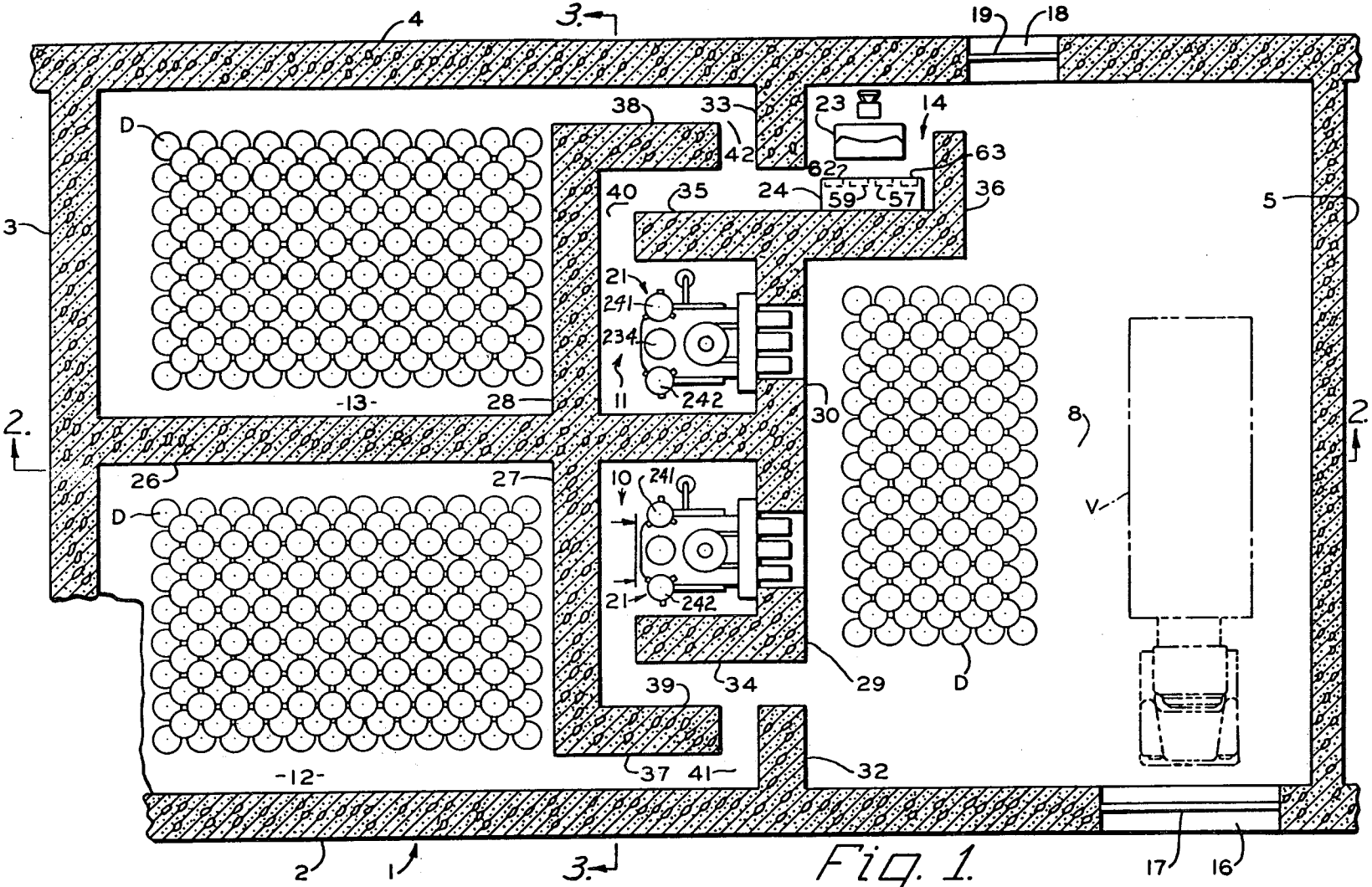
FIG. 1 is a plan section along line 1—1 of FIG. 2, of a building and internal equipment embodying the present invention and for carrying out processes of the invention, the scale being much smaller than full size.

For illustrative purposes, the below described embodiment of the invention will be described in connection with the disposition of radioactive waste material in the form of resin particles containing radioactive materials like those described above, and in the form of evaporator bottoms, by putting the radioactive material including water, and cement as a solidifying agent, into a steel drum; mixing these materials in the drum; moving the drum into storage; allowing the mixture to solidify and radioactivity to decay in storage; and then moving the drum to a vehicle for transportation.

For convenience, the term "drum" is used hereafter to designate steel drums or barrels as such, as well as suitable other types of containers for the indicated purposes.

The reference numerals used herein and the terminology employed correspond to those used in said co-pending application Ser. No. 182,088, the entire disclosure of which is hereby incorporated by reference and made a part of the disclosure of the present application.

Figure 2:
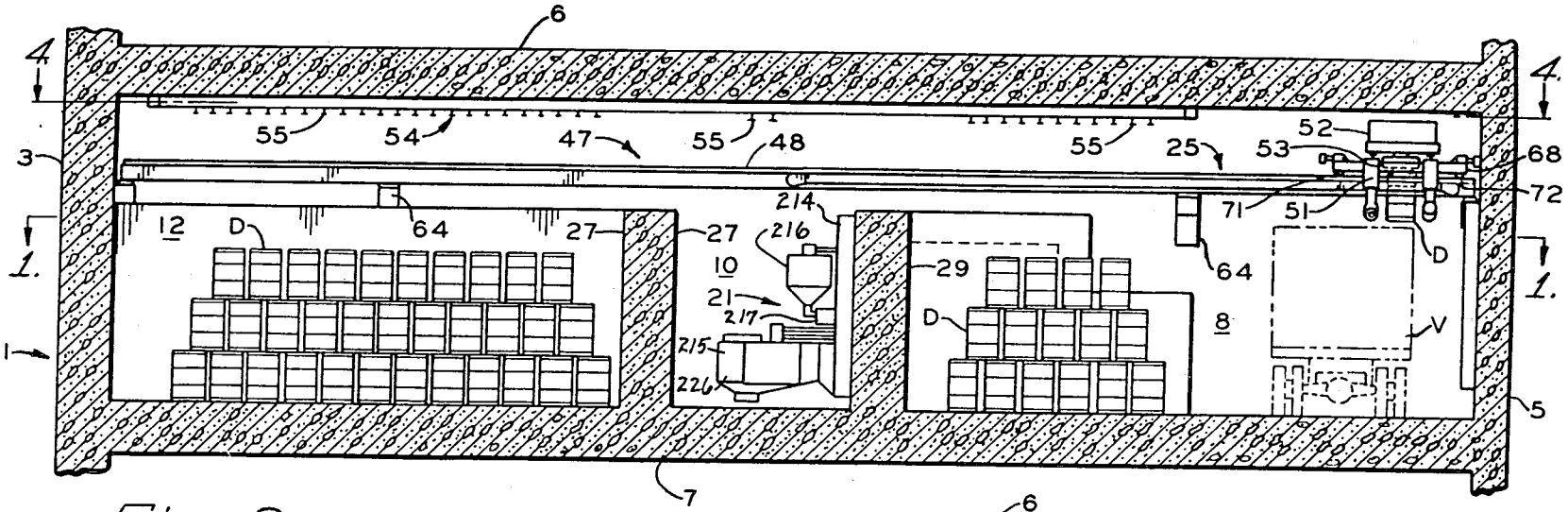
FIG. 2 is a section along line 2—2 of FIG. 1 and to the same scale.
Figure 3:
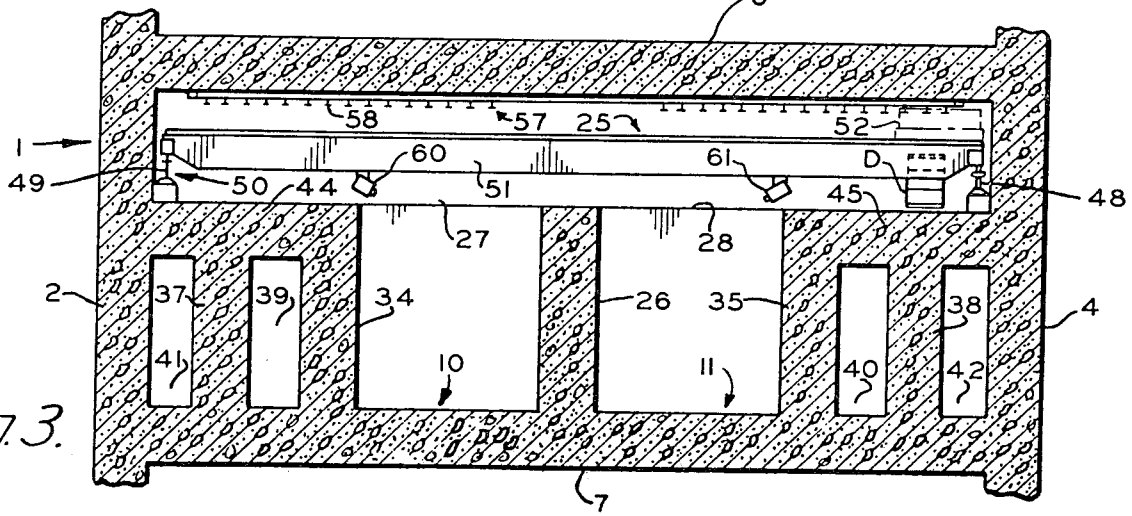
FIG. 3 is a section along line 3—3 of FIG. 1 and to the same scale.

The equipment generally shown in FIGS. 1-3 comprises a building 1 of rectangular configuration in plan, of which building upright walls 2, 3, 4 and 5, the ceiling 6 and the floor 7 are preferably formed of poured reinforced concrete, of sufficient thickness to prevent escape of harmful radiation from the interior of the building. The building interior is subdivided into an area 8, two drumming stations 10 and 11, two storage vaults or decay pits 12 and 13, and a control station 14 in which an operator is located to operate the system by remote control.

Area 8, which is free of radioactive materials or radioactivity at all times except temporarily when radioactive materials are being shipped form the building, is shown as used for storage of non-radioactive materials such as drums D that contain no radioactive materials but may, and in this illustrative embodiment do, contain accurately weighed preloaded amounts of cement as a solidifying agent. The area 8 has in wall 2 a vehicle doorway 16 having a door 17 which may be of conventional automatically controlled type. A personnel doorway 18, having a conventional door 19, is in wall 4 near station 14.

Each drumming station 10 and 11 is equipped, as described below, with apparatus 21, operable by remote control from apparatus 23, 24 in operator control station 14, for introducing radioactive materials and water into drums D, each preloaded with accurately determined amounts of dry cement as a solidifying agent, all in proper proportions to permit these materials after thorough mixing to form in the drum a solid body of controlled weight, and for then thoroughly mixing these ingredients.

A drum D containing the resulting mixed radioactive material, cement and water may then be stored in a storage vault 12 or 13 to permit solidification of drum contents and decay of radiation until its intensity is reduced to shipable limits. The drums are individually identified, and location of and time that each is placed in storage is recorded. After lapse of an appropriate time, the drums are moved out of the storage vault onto a vehicle V for transportation away from building 1 for suitable disposition. If the radiation intensity of the drum contents is initially so high that it is not reducible by storage for a permissable or reasonable time, the drum can be put into a known type of radiation shielding cask that renders the drum safe for shipment. If, on the other hand, the initial radiation intensity is sufficiently low, the drum may be shipped immediately, without storage.

Figure 4:
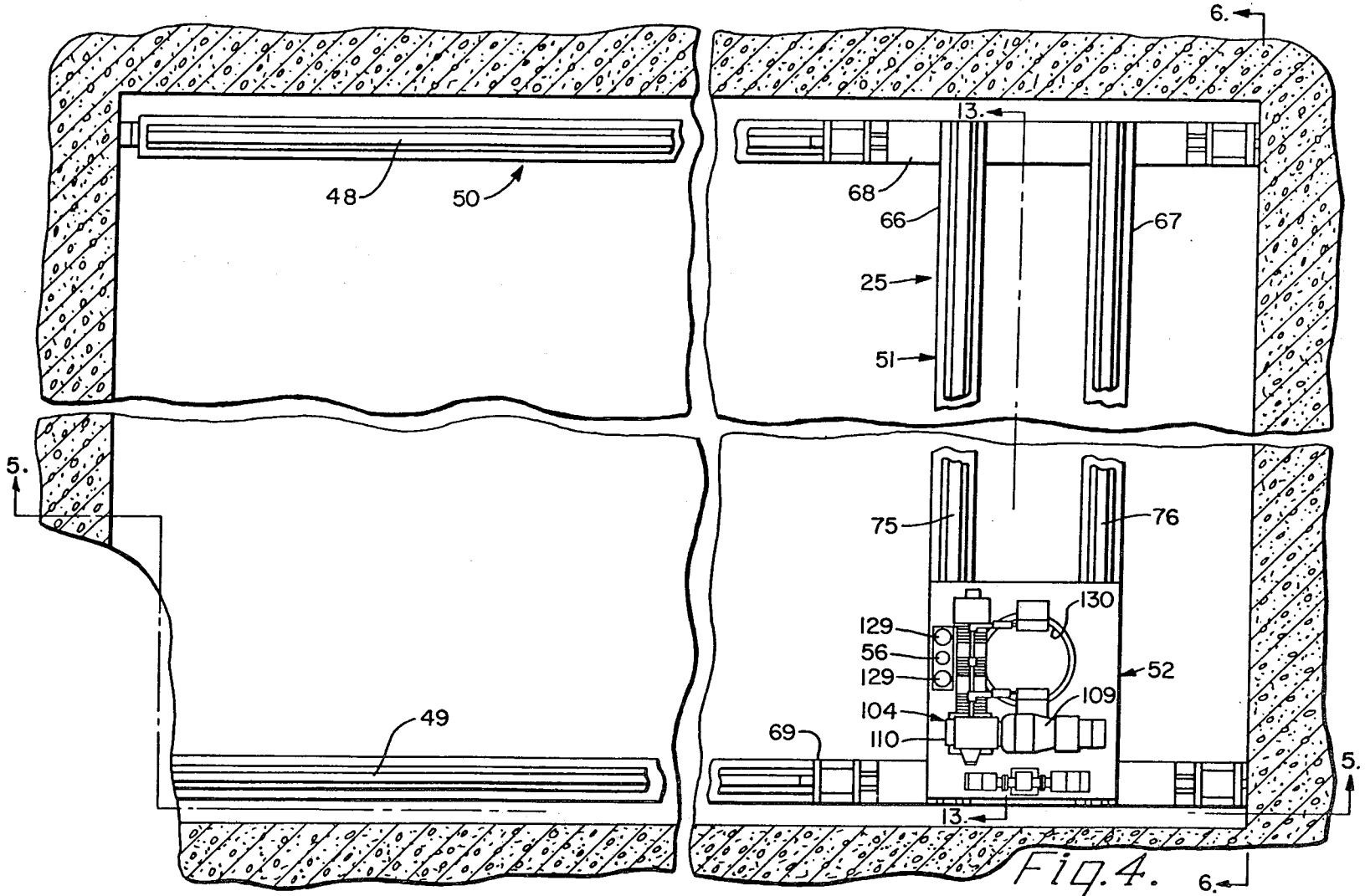
FIG. 4 is a plan section along line 4—4 of FIG. 2 and to a somewhat larger scale showing the overhead crane apparatus, the crane being in a somewhat different position than in FIG. 2.

A drum D is picked up from area 8, put into a selected drumming station 10 or 11 then after proper filling and mixing moved if desired into a selected storage vault 12 or 13; and when desired moved onto vehicle V by remotely controlled overhead crane apparatus 25 (FIGS. 2, 3, 4) to be described later.

These operations are performed by remote control without actual visual access, the operations being viewed through television screens and monitored by other means described below.

Building

The interior of the building 1 is subdivided (FIGS. 1, 2, 3) into the storage vaults 12 and 13 by a thick center interior wall 26 and transverse end walls 27 and 28 that are joined to wall 26 and extend into relatively close proximity to but stop short of exterior side walls 2 and 4. Transverse walls 29 and 30 longitudinally spaced from interior walls 26 and 27, and stub walls 32 and 33 joined to outer side walls 2 and 3 and spaced from transverse walls 39 and 30 set off the area 8 and station 14 from the vaults and drumming station. Spaced transverse walls 27 and 29, and 28 and 30 together with a portion of center wall 26 and longitudinally extending intermediate stub walls 34 and 35 define the drumming stations 10 and 11.

An extension of wall 35 and a short transverse wall 36 joined to it define the operator station 14.

Walls 34 and 35 together with overlapping longitudinal wall portions 37 and 38 respectively fixed to transverse walls 27 and 28 and respectively spaced from walls 2 and 34 and from walls 32 and 33, define labyrinthian passages 39, 40, 41 and 42 that prevent lateral escape of radiation from storage vaults 12 and 13 and the drumming stations 10 and 11 into area 8 and control station 14, while permitting access to the drumming station and vaults during construction and later if necessary.

All of these walls are of sufficient thickness and formed of suitable material such as poured concrete, to prevent passage through the walls of harmful radioactive radiations.

The interior walls defining the control station, drumming stations, storage vaults and labyrinthian passages extend to locations below ceiling 6 and are suitably shaped at their tops to permit clearance for the overhead crane apparatus 24 so that it can move over and service the entire interior areas of building 1. The labryrinthian passages and the control station have roofs 44, 45 for safety and added shielding of personnel.

Crane Apparatus

The crane apparatus including a system for locating the drums is illustrated in FIGS. 2 through 29.

The crane apparatus comprises a track 47 including rails 48, 49 extending lengthwise of the building, a bridge 51 that travels on the track, a trolley 52 that travels on the bridge and a grab 53, adapted to carry a drum D, that is carried by and raised and lowered and manipulated from the trolley. As described below, the grab is provided with remotely controlled means to mechanically grasp securely a drum D at its upper upstanding circumferential edge 50.

Indicating means 54 above the trolley is provided to aid the operator, by remote control from control station 14, in accurately locating and grasping a selected drum, or accurately locating and placing a selected drum, or moving it, in or out of storage area 8, a drumming station 10 or 11, or a storage vault 12 or 13.

The indicating means, to be described below, has on it indicia 55 (FIGS. 2, 3, 28, 29) marked, as by number and letter combinations, that can be viewed and identified by an upwardly directed television camera 56 (FIGS. 4, 7) on the trolley that transmits an image to a television monitor screen 57 (FIGS. 1, 51) in control station 14. By suitable movement of the bridge and the trolley on the bridge the trolley can be moved to and accurately located over a desired location for a drum by scanning through the television camera to find a desired indication on the ceiling, the camera preferably having cross hairs on other markings to aid location as described later.

The grab will also be provided with a downwardly facing television camera 58 (FIGS. 18, 19) that can focus on the center of the drum. Preferably this camera has on it markings that, when the grab carrying the camera is lowered a suitable distance, coincide with markings or structural features on a selected drum to indicate the height of the grab relative to the drum on a second television monitor screen 59 (FIGS. 1, 33) located in control station 14. By this means, the grab can be accurately located over the proper drum at the proper height, after which the grab can be actuated to grasp and lift the drum; and the grab while carrying a drum can be located in a proper location to place the drum.

Figure 33:
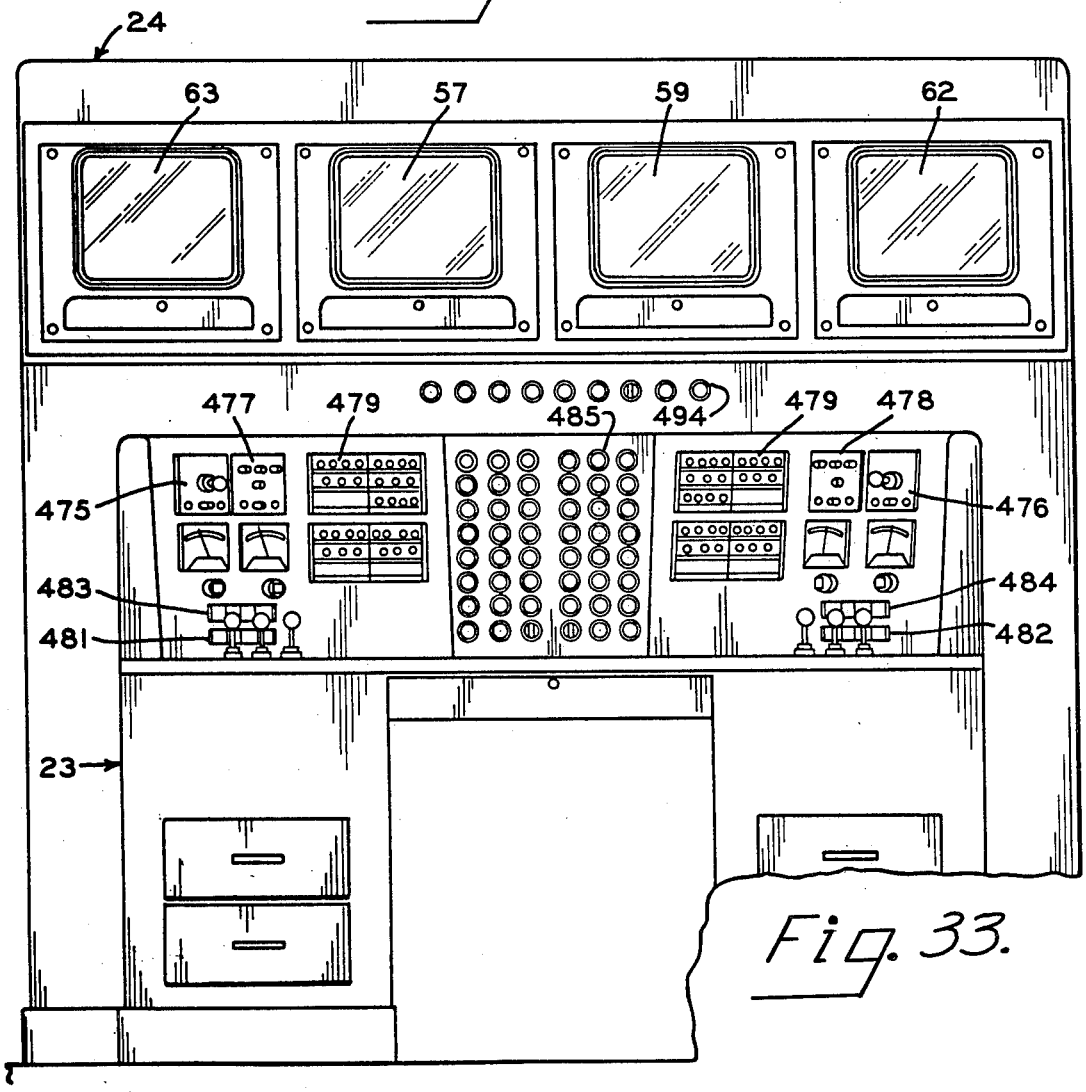

Four adjustable surveillance television cameras 60, 61 (FIGS. 3, 4) are mounted on the bridge 51 at suitable locations so they can scan downwardly to view other locations; these cameras can respectively show their viewed scenes on monitor screens 62, 63 in station 14 (FIGS. 1, 33).

As further indicated below, the grab is designed to grasp the edge of a drum that may have toppled to turn the drum so its top is up, or to remove the drum.

The track rails 48, 49 are supported from brackets 64 extending from the walls of the building; the rails extend substantially throughout the length of the building so that the grab 53 carried by the trolley, by suitable manipulation of the bridge and trolley can service substantially the entire internal area of the building between the rails. Suitable control means, which may be of known type, are provided in the control station 14 at the monitor screens so that the crane and grab can be operated by an operator at the station. A record board 65 (FIG. 30) will beprovided on which tags will be hooked bearing location indicia, date of filling and storage, radiation level and other data for drums that have been filled and are stored in the storage area.

The interior of the building is designed to provide a radiation-free area at one end in which maintenance work may be carried out on the crane. Such area is protected by shield walls from radiation from radioactive materials in the storage vaults 12, 13 or in drumming stations 10, 11; area 8 may be used for such purpose in the illustrated embodiment.

Bridge 51 comprises beams 66, 67 fixed at each end to carriage structures 68 and 69 each having flanged wheels 71 and 72 that travel on one of the rails of the track. In each carriage structure one of the wheels is power driven as described later to move the bridge along the track as desired. The bridge beams carry spaced parallel rails 75, 76.

At each side, the trolley 52 has two wheels 77 and 78 that travel on these rails 75 and 76. One set of wheels 78 is freely rotatable; the wheels 77 of the other set are power-driven by electrically energizable drive means 79 on the trolley, that is controlled by suitable known means from the control station 14.

Drive means 79 comprises (FIGS. 7–13) a transmission unit 81 adapted to drive the wheels 77 of the power-driven set from shaft 82 (FIGS. 11, 12) through universal joints 83 connected to the drive axles 84 on which the wheels are rigidly fixed. Shaft 82 is rotated by a gear 85 driven by pinion 86 mounted coaxial with and rigidly connected to gear 87 which is rotated in turn by pinion 88 rigidly mounted on the same shaft as gear 89. Gear 89 is rotated by a pinion 91 mounted on a shaft 92 directly connected to an electric motor 93 of substantial power. Shaft 92 is also adapted to be connected through an electrically operated magnetic clutch 94 to shaft 95 of an electric motor 96 of less power which drives shaft 94 at a substantially lower speed than motor shaft 92, through gear reducer 97 integral with motor 95. Motors 93 and 96 may be of known types.

When the clutch 94 is disconnected and the motor 93 is energized and motor 96 preferably de-energized, the trolley 52 can travel at a relatively high speed on the bridge 51. When clutch 94 is engaged and motor 93 is de-energized while unit 96 is energized, the trolley 52 travels at a substantially lower speed. Therefore, while motor 96 is energized for low speed operation of the trolley the motor 93 is de-energized and is rotated from motor 96; while motor 93 is energized for high speed operation of the trolley motor 96 is de-energized and disconnected by clutch 94 from the transmission unit and motor 96 to prevent damage to motor 96 from overspeeding. These differences of speeds are to enable the trolley to be moved along the bridge by motor 93 at a relatively high speed to within a close distance of its destination, and then to be moved slowly by motor 96 to its final location. Moreover, each of motors 93 and 96 respectively has its own isolated power lines forming part of known energizing and control means diagrammatically indicated at **93*e* and 96*e* (FIGS. 10, 50) connected to and controlled from control station 14. The clutch is also energized and controlled from the control station 14 by means diagrammatically indicated at 94*e*** which may be of known type. Consequently, in the event of failure of either one of the motors or its power lines, the trolley can still be moved on the bridge by the other motor to a desired location on the bridge.

Two wheels 71 of the bridge are freely rotatable, while the other two wheels 72 are driven (FIGS. 5, 13) by means similar to that which drives the trolley. In this case, each wheel 72 is connected to a drive shaft 97 that is connected through universal joints 98 to the output shaft 99 of a transmission unit 100 substantially identical with the transmission unit 81 that drives the trolley. Power is supplied to this transmission unit by a motor 101 of substantial power that is adapted to provide a relatively high speed drive, and alternatively by geared down motor 102 of lower power to drive the bridge at a relatively low speed. The mechanism inside of transmission unit 100 is essentially the same as that of transmission unit 81 on the trolley and includes a clutch adapted to be electrically energized and controlled through means **103*e* from control station 14 by known means to connect and disconnect motor 102 from transmission output shaft 99. Motors 101 and 102 are also adapted to be electrically energized and controlled by known means 101*e* and 102*e* from station 14. In this case also, higher speed motor 101 is adapted to move the bridge to the vicinity of its final destination at a relatively high speed, and then can be de-energized and lower speed motor 102 can be energized to move the bridge slowly to its final destination. Moreover, each of motors 101 and 102 has its own isolated independent electrical power supply means and is independently controlled from station 14, so that in the event of failure of either of the motor units or its power supply means, the outer motor unit can be used to move the bridge to area 8 as far away as possible from vaults 12 and 13** so maintenance can be safely performed.

Trolley 52 also contains grab hoisting means 104 (FIGS. 5–10, 14–17) which comprises a winch drum 105 adapted to wind on and unwind from it lifting cables 106, 107 and 108 that support and raise and lower the grab 53. This three cable arrangement supports the grab in a level position with great stability so that tilting of the grab is prevented and swinging is eliminated; it also helps insure accuracy of grab locations and provides added safety. The winch drum 105 is adapted to be rotated by a power unit 109 (FIG. 7), and is also adapted by means 110 to be moved longitudinally as required to cause the cables to wind on and unwind from the drum without piling up on the drum and also to cause the locations where the cables wind on and leave the drum to remain laterally fixed with respect to the trolley.

The power unit for rotating the drum comprises (FIGS. 7, 9, 10, 14, 15) a known commercial unit such as the "Reuland Hydraulic Pump Mount Motor", manufactured by Reuland Electric Company of Howell, Michigan and Industry, California. This unit comprises a first relatively high power, high speed electric motor 112, and a second relatively low power, low speed electric motor 113 each directly connected to a shaft 114 (FIG. 14) that through a gear reducer unit 115 rotates the shaft 116. An individually electrically operable brake unit 117 is also connected to shaft 114. Each of motors 112 and 113 has its own isolated power lines and is independently controlled from control station 14 by known means 112*e*and 113*e* (FIGS. 10, 50); brake unit 117 is also independently controlled as required from the control station 14 by either of two isolated electrical circuits 117*e* and 117*e'*. By means motor 112 (operating for example at 1800 rpm) can cause the winch drum to rotate at a relatively high speed for relatively high speed operation to bring the grab into relatively close proximity to its ultimate height level for its destination, and then motor 112 can be de-energized and the other motor 113 (operating for example at 450 rpm) can be energized to rotate the drum relatively slowly to accurately locate the grab at its proper level. Moreover, this arrangement makes possible a safety feature in that if either of the motors fails or its power supply unit fails, the other motor can be energized to lower the grab or to raise it, with or without a drum D, and enable the trolley to be moved and bridge to be moved to a place where the failed unit can be corrected.

The brake unit 117 is of the spring loaded type that applies braking force to the shaft 114 when the brake unit is not energized, and must be energized to release the brake to allow the shaft to turn, which provides another safety feature.

Shaft 114 (FIGS. 14, 16) drives a worm 118 that meshes with a worm wheel 119 rigidly mounted on a rotatable axle portion 121 that slidably but non-rotatably carries shaft 116 on which the winch drum 105 is rigidly mounted. One end of shaft 116 is carried by a bearing 122 in a sleeve 123 that rotatably and slidably supports shaft 116. The other end of shaft 116 has an internal screw thread portion 124 that meshes with an externally threaded screw 125 rigidly carried at the end of the housing reducer 115. As the worm wheel 119 rotates, it rotates shaft 116 and the drum 105 on it. Since screw 125 is stationary on the trolley, rotation of shaft 116 causes the sahft and its winch drum to move axially by interaction of threaded portions 124, 125. The thread pitch of these portions is such that they cause the drum so to move axially that the cables 106, 107, 108 wind on and off of the drum without laterial movement relative to the trolley of the location where any cable winds on or unwinds from the drum. The winch drum is of the same diameter where the cables 106, 107, 108 wind on and off the drum and these portions of the drum preferably have helical grooves 126 for each cable to aid in insuring level unwinding and winding of the cables and maintaining lateral positions of the cables relative to the trolley. Therefore all cables unwind and wind evenly and at the same rate and in unchanged lateral positions relative to the trolley to prevent tilting of the grab, provide a stable level position of the grab, simplify control of the grab, and contribute to safety.

Because of the worm 118 and worm gear 119 and brake 117, the winch is self braking and halts when its power supply is de-energized. The apparatus also includes (FIG. 14) a disk 127 fixed to the end of the worm, having a notched periphery that passes through a proximity switch 128 that acts as a counter connected to known means 128*e* comprising known indicating means in the control station 14 to indicate the number of revolutions of the worm and hence of the winch drum 105. The height of the grab can thus be indicated in the control station.

The trolley also carries an upwardly directed television camera 56 of known type connected by know means 56*e* (FIGS. 17, 50) to the monitor screen 56 and controls in the control station, to show on the screen the scene that is viewed by the camera, including locating indicia 55. Utilizing this means, and by suitable control of the bridge and the trolley, the trolley can be properly positioned to enable the grab 53 to be located over a drum or other item to be handled, as will be described later. Light fixtures 129 of known type may be mounted adjacent the televison camera to illuminate upwardly the scene viewed by the upwardly facing television camera. These light fixtures are divided into two separate sets each set having its own isolated known circuit means 129*e* by which it is electrically energized and controlled from control station 14.

The trolley 52 has an opening 130 through which the three cables 106, 107 and 108 extend downwardly to support the grab 53. These cables are arranged so that they support the grab at locations that are equidistantly and equiangularly spaced around an axis A of the grab. To accomplish this, cable 107 passes directly from winch drum 105 to the grab, while cables 106 and 108 pass from the winch drum 105 over guide pulleys 131 and 132 fixed to the trolley and under weighted pulley 133 and 134 fixed to supporting and tension sensing means 135. Means 135 operates so that if dable 106 or 108 becomes slack or loses tension its weighted pulley 133 or 134 will lower and also trip a known limiting device 136 (FIG. 7) such as a limit switch, the function of which will be later described.

Trolley 52 includes means for automatically limiting and halting upward travel of the grab 53. The illustrated means comprises (FIGS. 7, 8) duplicate limit switches 137 mounted on the trolley and having a common actuating lever 138, the free movable end of which extends over trolley opening 130 so the end can be contacted and moved by the top of the grab 53 when it reaches the upper end of its travel. The lever 138 is affixed to duplicate cams 139 that actuate the limit switches to interrupt electrical current to whichever of hoist motors 112 or 113 is operating; the circuitry is such that when the grab is to be lowered, the circuits to the motors can be completed.

Thus the trolley has redundancy of power means and controls so that is one power means that moves the trolley or grab fails, another completely separate power and control system is available, and if one set of lights 129 fails, the other is independently available.

Grab

The grab 53 (FIGS. 9, 10, 18–22) which is adapted to be raised and lowered by three cables 106, 107 and 108 comprises a rigid frame 140 to which the lower ends of the cables are connected, each through a length adjusting means 141 to permit the length of all of the cables to be accurately equalized to support the grab in the desired level horizontal position. Frame 140 is of generally circular configuration and has a central axis A about which the cables are equidistantly and equiangularly located. Frame 140 rotatably supports by bearing structure 142 a subframe 143 that is rotatable about axis A. Subframe 143 carries, equidistantly and equiangularly about axis A, three sets of clamping fingers 144 adapted to clamp the upstanding edge 50 of each drum D. Each set of fingers comrises (FIGS. 9, 10, 19) a finger member 145 that is pivotally supported at its upper end from frame 143 and has a toothed jaw portion 146 rigidly joined to its lower end. This finger member is limited against inward tilting movement by its inwardly transverse lug 147 that bears against a stop nut 148 adjustably mounted on a bolt 149 threaded into subframe 143; and the finer member is yieldably limited against outward tilting movement by compression spring 151 that bears against the other side of transverse lug 147 and against a nut 152 adjustably threaded on bolt 149.

Finger member 145 pivotally carries near its lower end a cooperating finger member 153 that has a downwardly extending portion 154 carrying a jaw portion 155 adapted to cooperate with jaw portion 146 of member 145 and a guide portion 156 that engages the outer side of the drum to assist alignment of the grab with the drum. Finger member 153 is of bell crank shape and has a transversely extending portion 157 pivotally connected through yoke link 158, compression spring 159 and bolt 160 to vertically movable actuating member 162. Acutating member 162 comprises a lower portion 163 to which link 158 of each set of fingers is connected, and a guide portion 164 that engages a grooved guide member 165 fixed to rotatable subframe 143 to prevent rotation of the actuating member relative to the subframe.

Actuating member 162 is moved vertically as required by a gear member 166 rotatably but immovably axially supported on subframe 143 and having external teeth 167 and internal threads 168 that engage external threads 169 on actuating member 162. Gear member 166 is rotated by a pinion 171 non-rotatably mounted on a shaft 172 rotatably carried by subframe 143 and rigidly mounting a gear 173 that is rotated as required (FIG. 18) by either or both of gears 174 and 175 mounted on electric motors 176 and 177. Preferably only one of these motors will be energized at a time, although both could be. Each of the motors has an individual isolated power supply and is individually controlled from control station 14 by known means diagrammatically indicated at **176*e* and 177*e*. These two motors are provided to insure that in the event of failure of either motor or its power supply, the other motor could actuate the finger sets 144. It is apparent that when either of the motors is actuated and gear member 166 is rotated to raise the actuating member 162, the finger members 145 and 153 of each set will close to grasp an edge of the drum; and when either of the motors is rotated to cause the actuating member to move downwardly, the finger members of each set are opened. Upward and downward movement of member 162 is properly limited (FIG. 21) by engagement of vertically space stop members 178 and 179 adjustably mounted on the upper end of actuating member 162, with actuating members 180 of duplicate electrical limit switches 181 that are suitably connected to motors 176, 177. Known circuit means 181*e* makes this possible and also sends signals to control station 14 giving information of the open or closed positions of the finger members 153. Operation of the finger sets 144 is also reported visually by camera 58** to the control station.

Subframe 143 carrying finger sets 144 and motors 176 and 177 is adapted to be rotated on frame 140 as required by an electric motor 183 on subframe 143 driving a worm 184 engaging a worm gear 185 that drives through shaft 186 and flexible coupling 187 a shaft 188 rotatably mounted on the subframe. Shaft 188 rigidly carries a drive pinion 189 having external teeth that engage internal teeth of an internal annular gear 190 bolted to frame 140. Motor 183 has its own independent power supply and is adapted to be controlled as required from the control station 14 by known means **183*e*. By energization of motor 183, subframe 143 carrying finger set 144 can be rotated as required about axis A to locate the grab fingers properly, to grasp the desired drum or other object to be grasped, or to orient the fingers or load carried by the grab to a desired angular position about axis A to clear parts of the apparatus or drums or other objects. In the illustrated embodiment, the amount of rotation is controlled and limited by engagement of the movable member 192 (FIGS. 18, 20) of limit switch 193 mounted on subframe 143 with angularly spaced stops 194 and 195 fixed on frame 140. The angular distance between stops 194 and 195 is somewhat over 120°, permitting the subframe and its fingers to be rotated so that the sets of fingers can cover at 360° circumference. The fingers thus can be turned to engage any desired portion of the circumferential edge 50 of a drum D. The fingers can readily grasp drums of varying sizes or out of round shapes, because of the pivoted supports of generally parallel members 145 and 158 and the spaced pivotal connections to these members of portion 157 of member 153. These supports and connections permit the finger sets to move substantial distances laterally and still be operative to grasp a drum edge. Guide portions 156 of members 153** can move the finger sets to accommodate out of round or differently sized drums.

Grab 53 also includes the television camera 58 that is directed downwardly. This television camera is mounted on a cover member 196 that is rigidly carried by main frame 140 of the grab, and is coaxial with the axis A of frame 140. It is located within the actuating member 162 which is made tubular for the purpose. Cable 197 carries the necessary wiring for the camera. Cover member 196 completely encloses the upper portion of the grab. The cover member and seals 198 and 199 between the main frame 140 and the subframe 143 insure against entrance of dust or other contamination to the bearings and gears to reduce maintenance problems. Electric power is supplied to the grab by cables one of which is shown at 200; each of the cables is looped in a housing 201 to provide a length of cable that maintains electrical connections as portion 143 of the grab rotates; the housing prevents snagging of the cable on other parts of the grab apparatus. Downward illumination is provided by lamps 202 connected to the subframe 143 around the lower edge of television camera 62; the lamps are divided into two sets each having its own individual isolated circuit means **202*e* by which it is energized and controlled from control station 14. Brackets 202*a*** may be provided to protect the lamps against damage.

Equiangularly spaced annular guides 203 on the outer periphery of the grab engage slotted guide brackets 204 (FIGS. 18, 22) on the trolley when the grab is in its uppermost position, thus laterally steadying the grab and its load when the trolley or bridge is accelerated or decelerated.

Figures 7, 8:
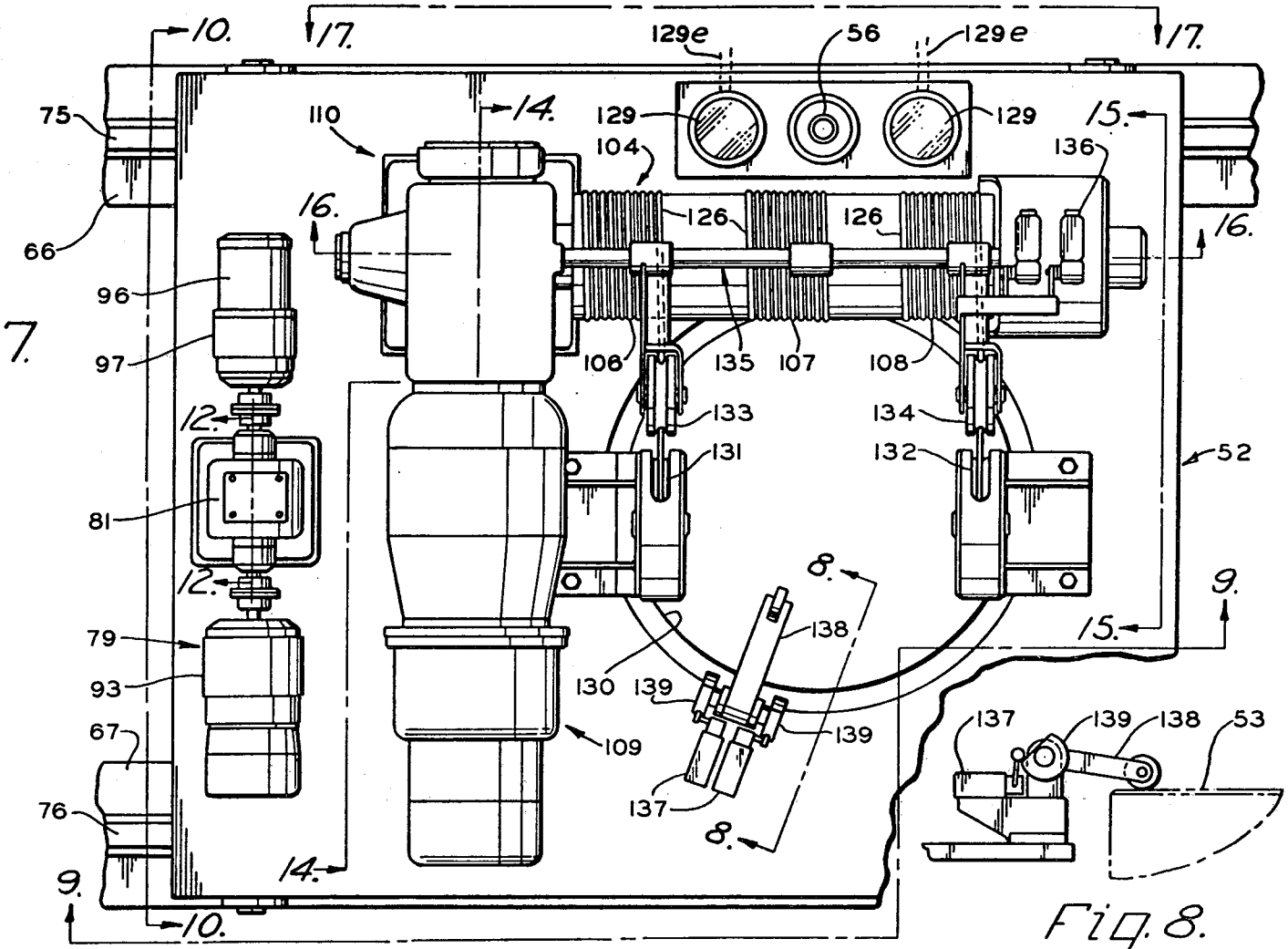
FIG. 7 is a plan of the trolley of the crane apparatus along line 7—7 of FIG. 5 and to a considerably larger scale.
FIG. 8 is a detail, along line 8—8 of FIG. 7, showing means for automatically limiting and halting upward movement of the grab carried by the trolley.
Figure 9:
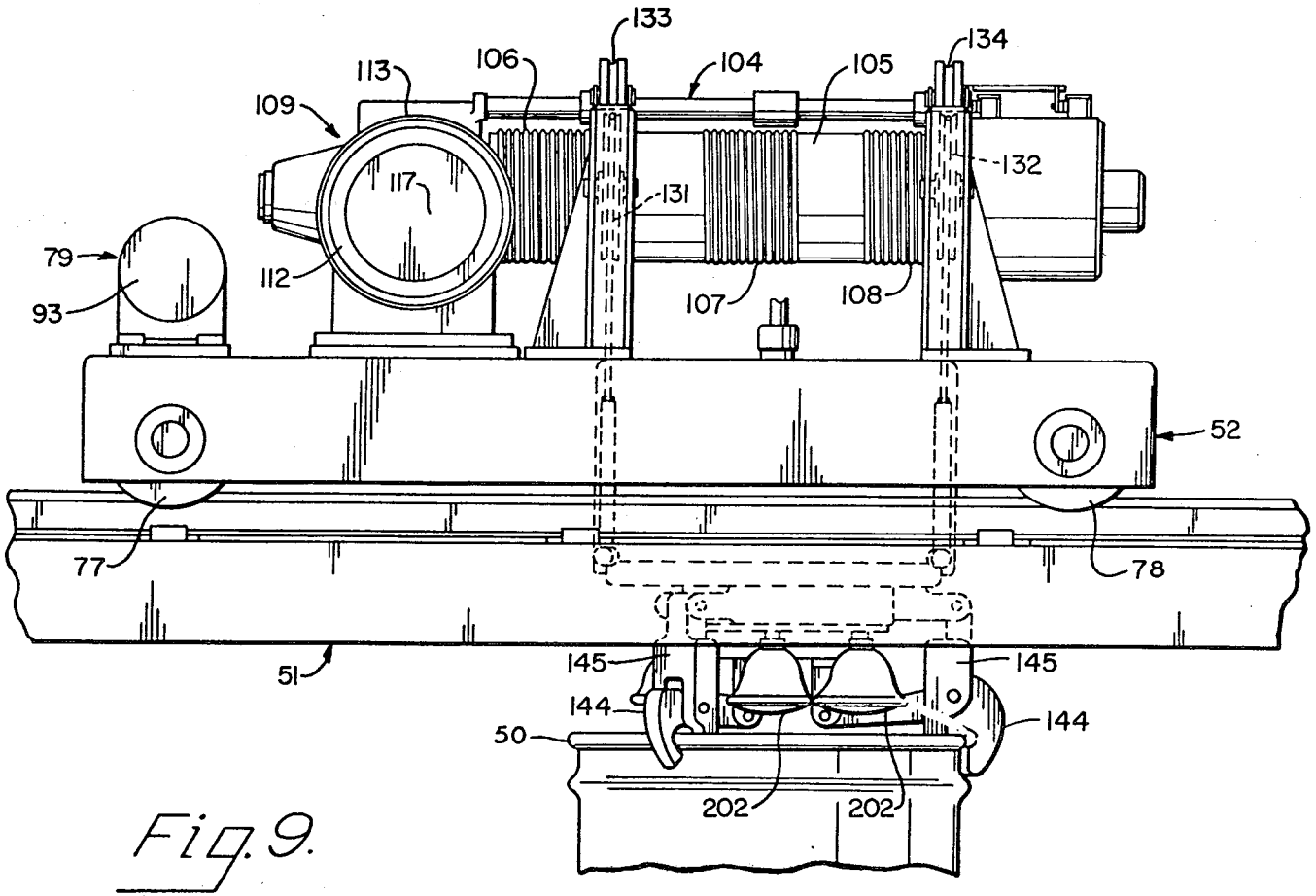
FIG. 9 is a view from line 9—9 of FIG. 7 and to the same scale.
Figure 10:
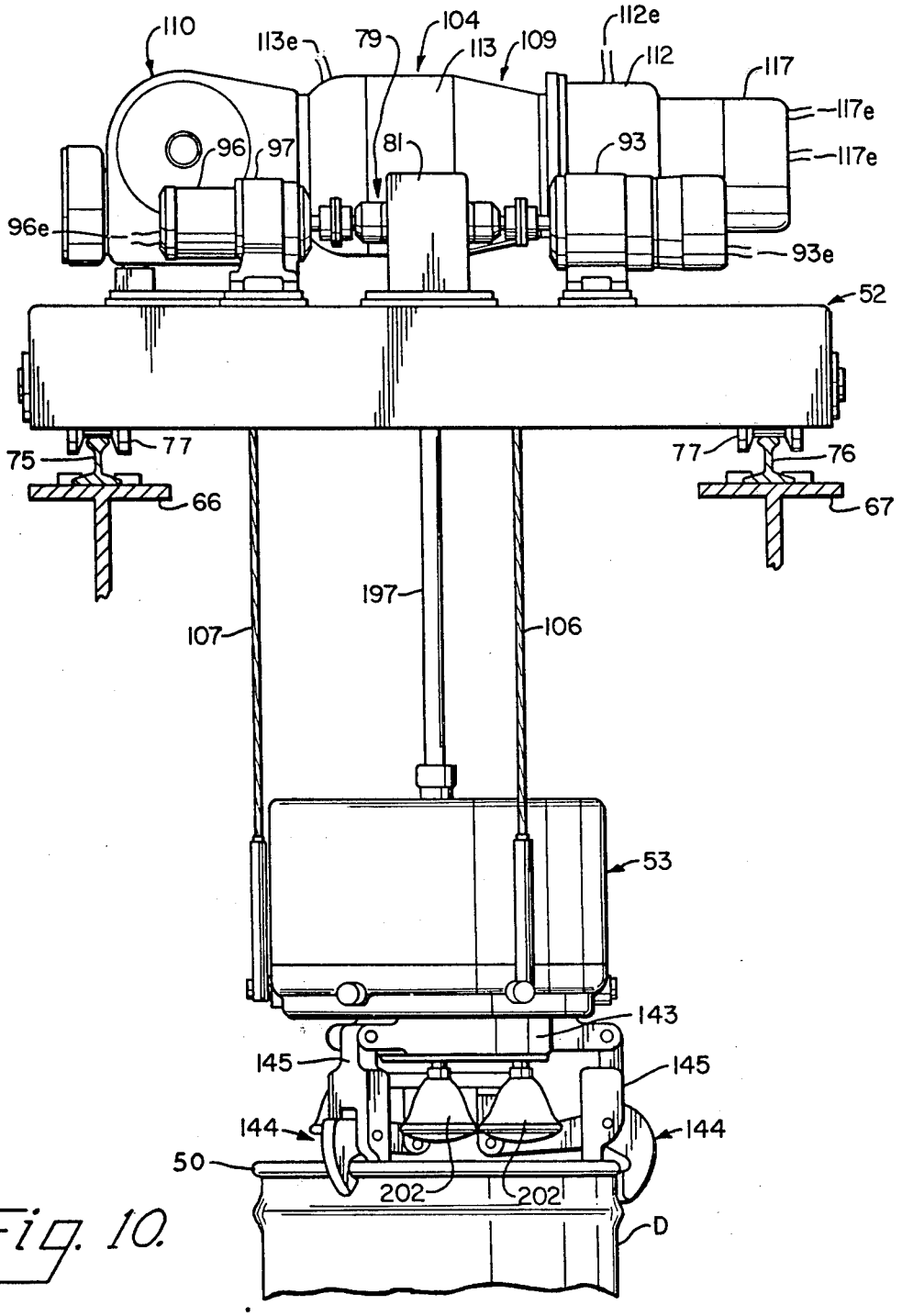
FIG. 10 is a view from line 10—10 of FIG. 7 and to the same scale.
Figure 11:
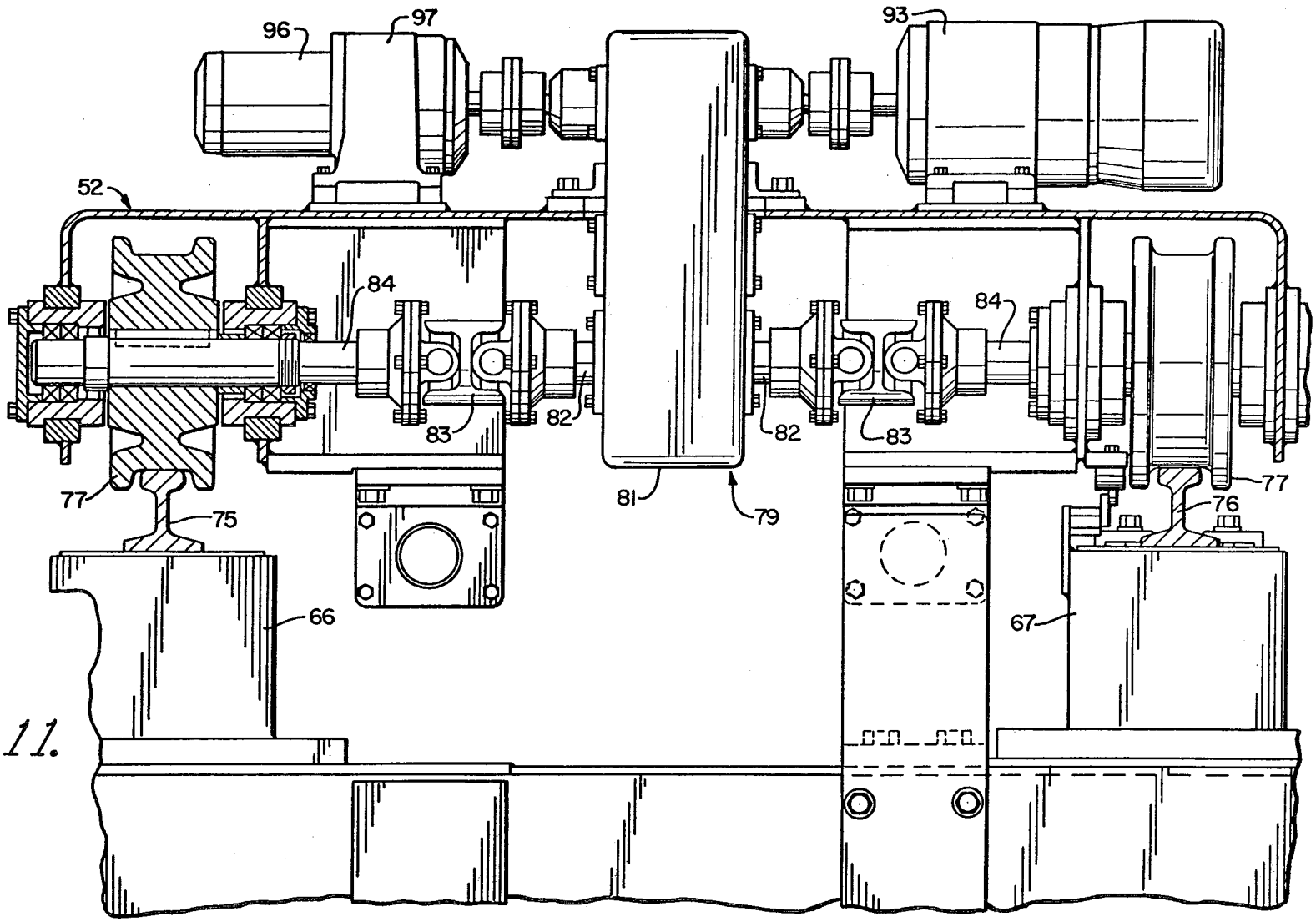
FIG. 11 is a view to a considerably larger scale of means for driving wheels of the trolley.
Figure 12:
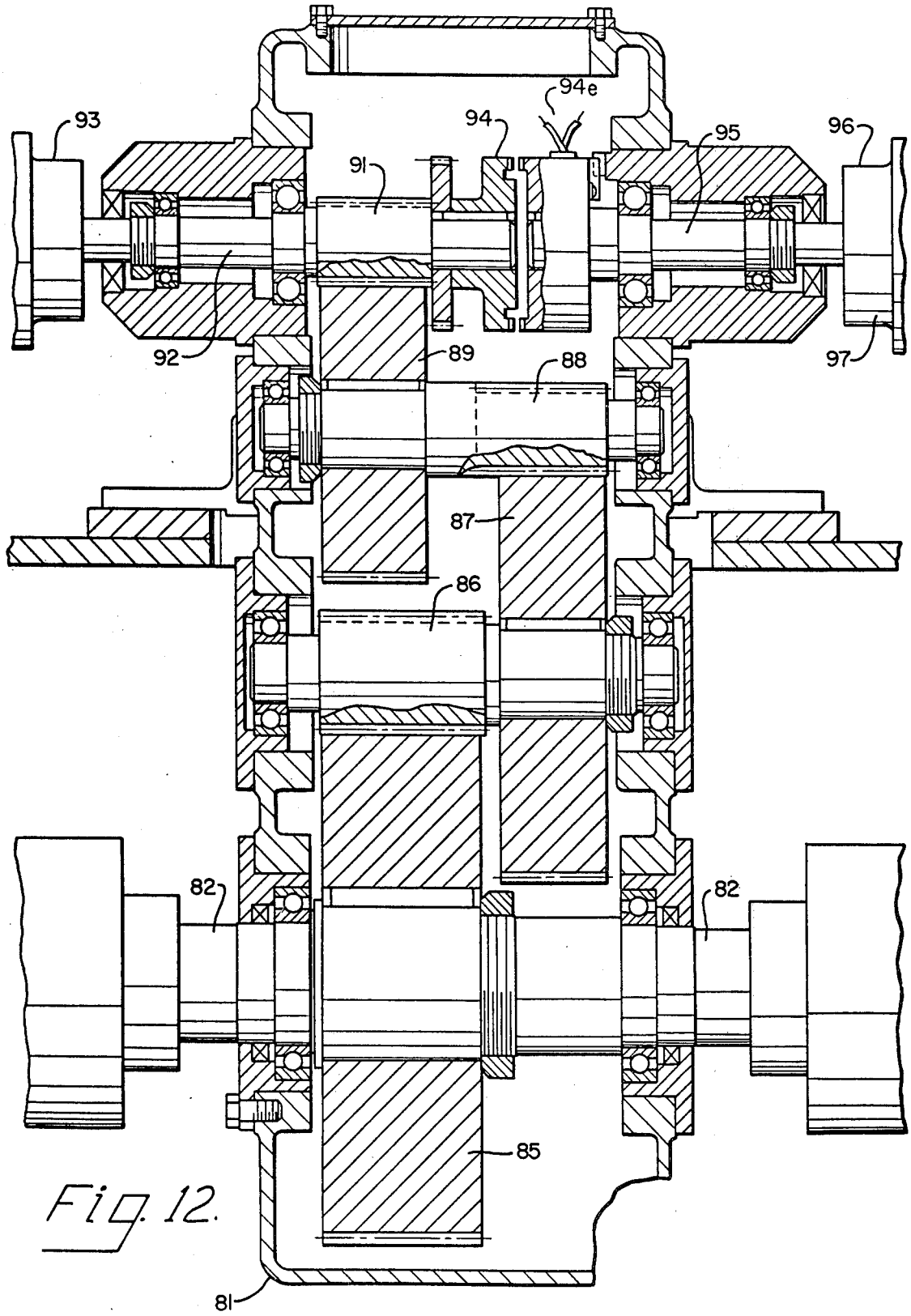
FIG. 12 is a view along line 12—12 of FIG. 7 and to a considerably larger scale showing the transmission box for the driving means of the trolley.
Figure 14:
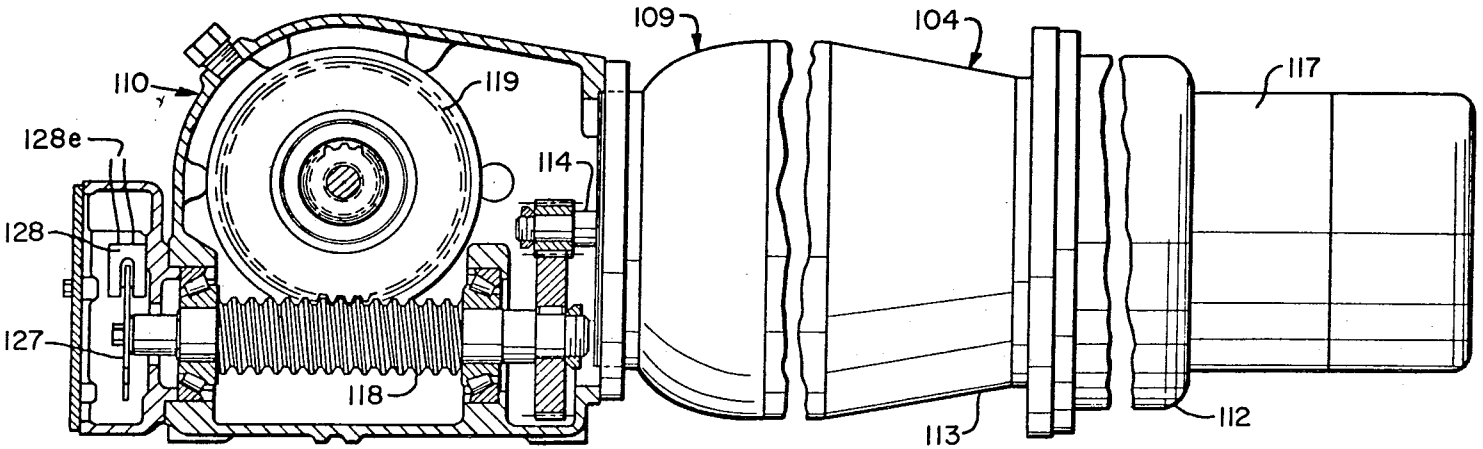
FIG. 14 is a view along line 14—14 of FIG. 7 showing a portion of the driving means for the grab hoist for the overhead crane.
Figure 15:
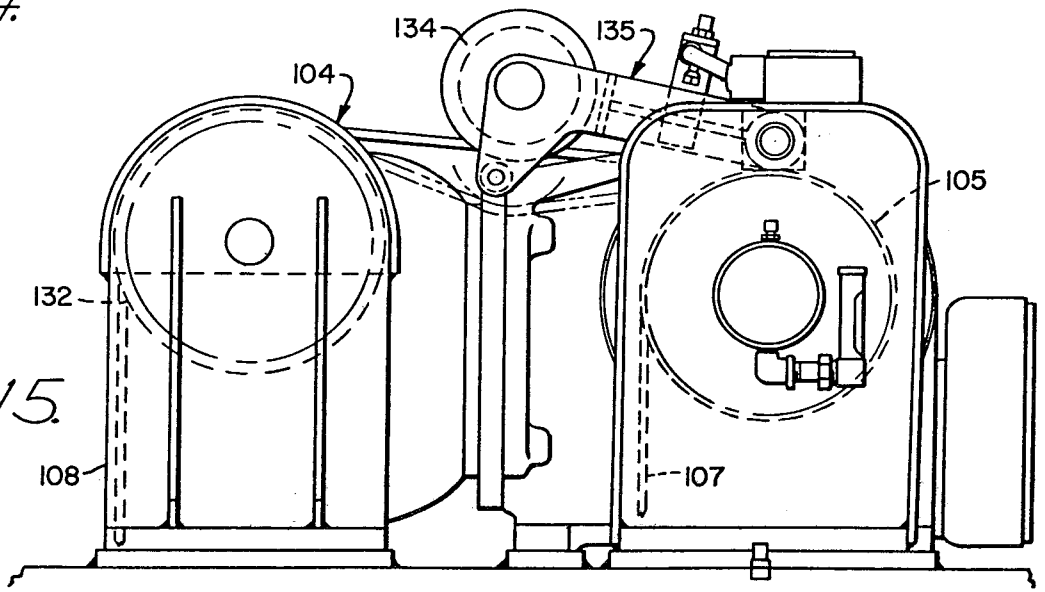
FIG. 15 is a view of the means for hoisting the grab from line 15—15 of FIG. 7.
Figure 16:
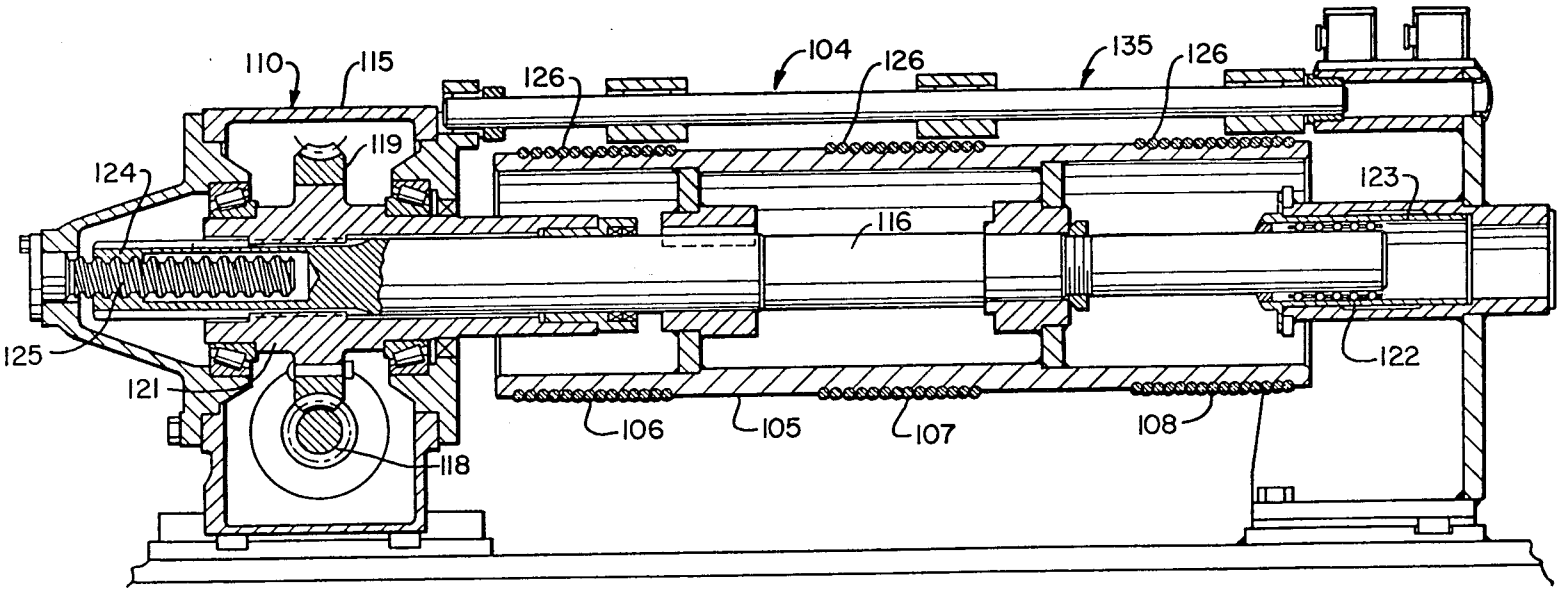
FIG. 16 is a section along line 16—16 of FIG. 7.
Figure 17:
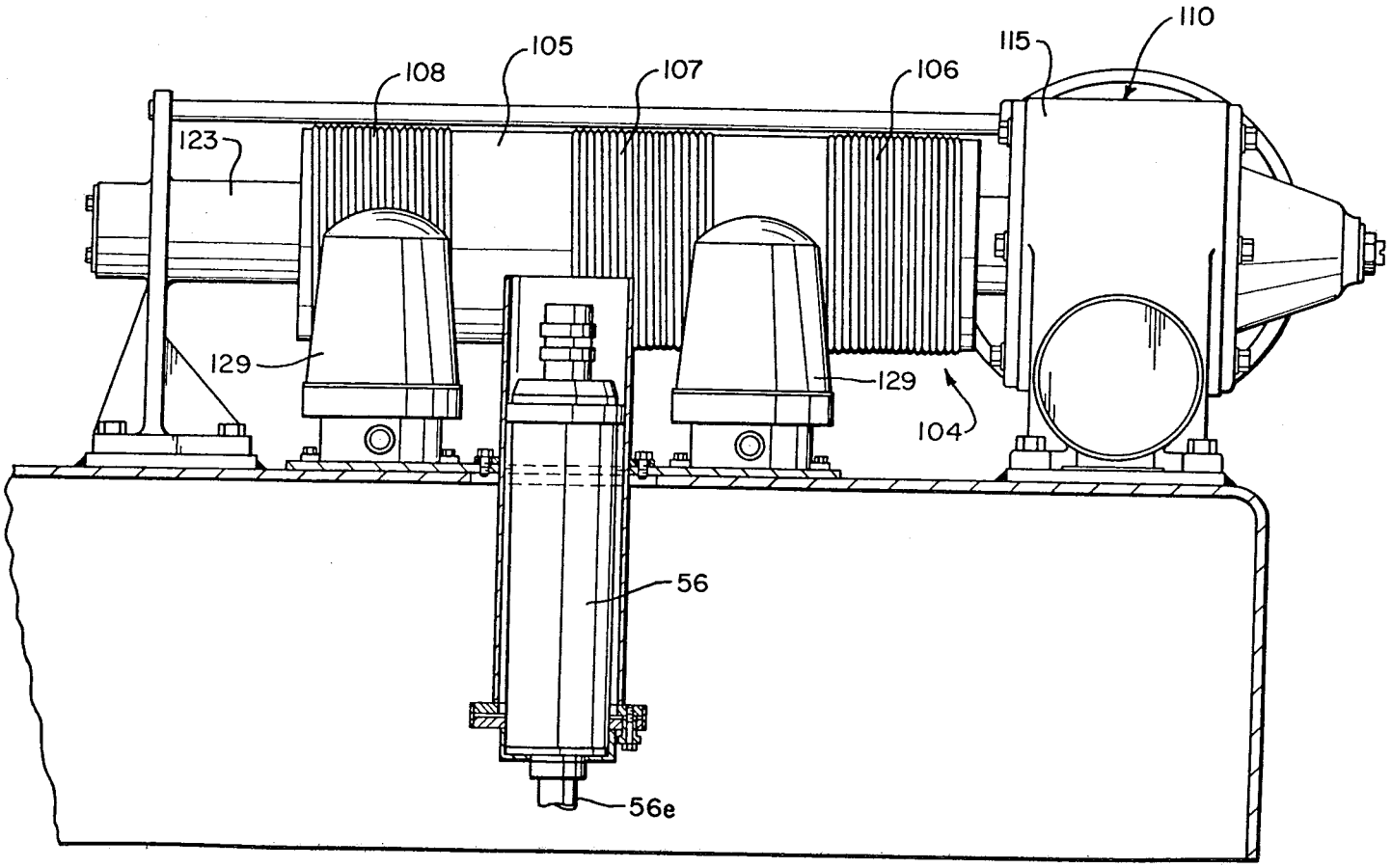
FIG. 17 is a view from line 17—17 of FIG. 7.
Figure 18:
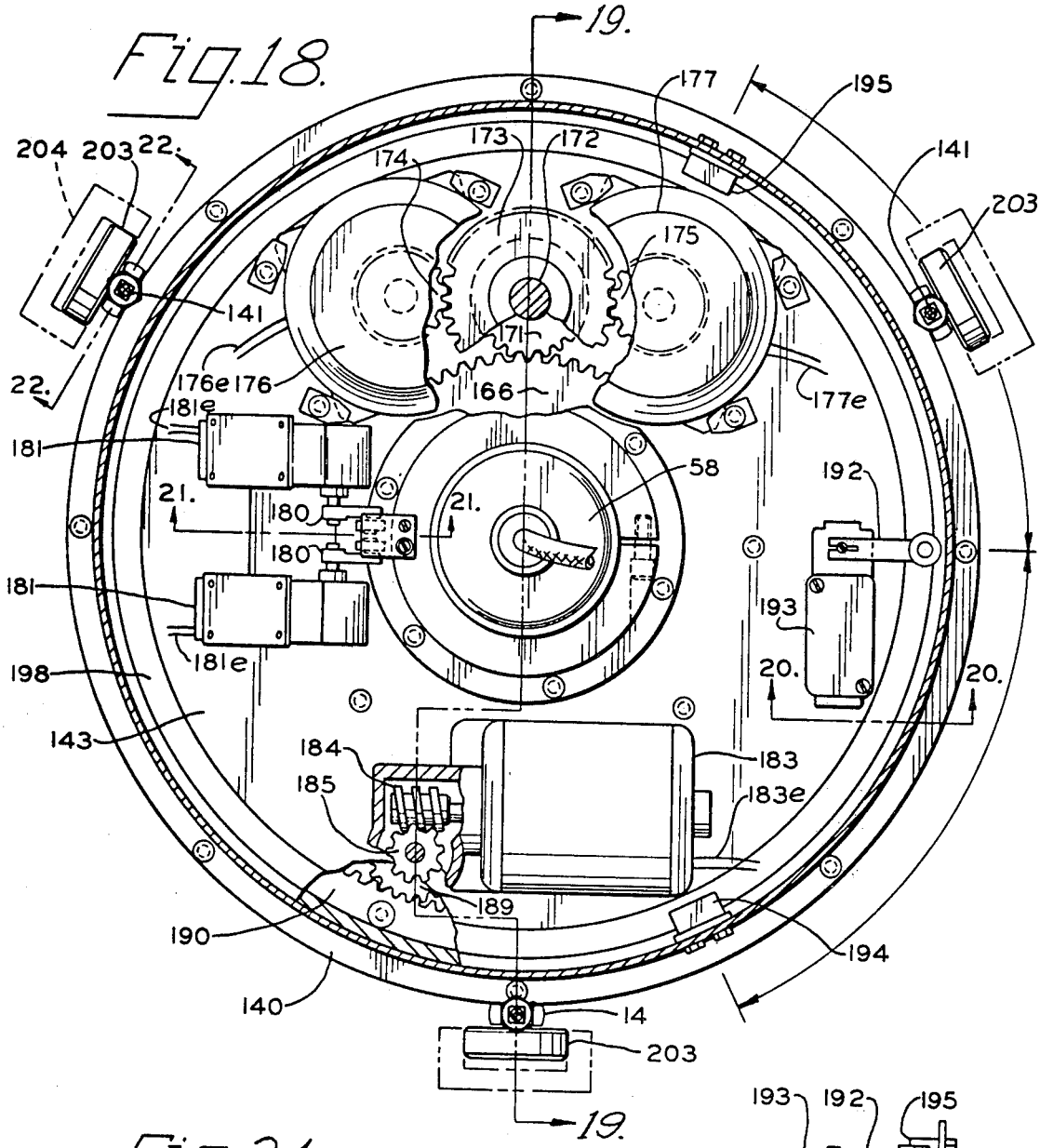
FIG. 18 is a plan view of the grab of the overhead crane, with the cover removed, the scale being considerably larger than that of the preceding Figures.
Figure 21:
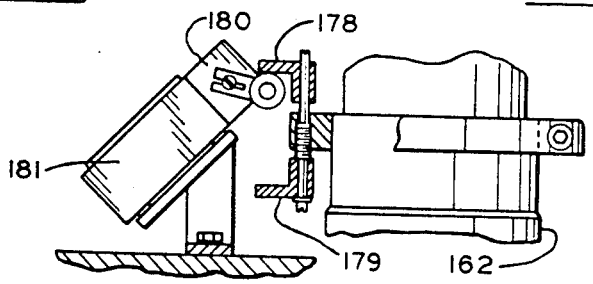
FIG. 21 is a section along line 21—21 of FIG. 18 showing limit switch means for limiting vertical movement of a part for actuating the fingers of the grab.
Figure 20:
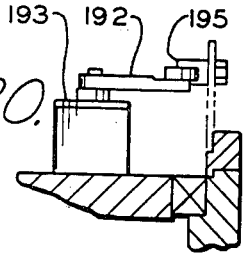
FIG. 20 is a section along line 20—20 of FIG. 18 and to a larger scale showing limit switch means for controlling rotational movement of a portion of the grab.
Figure 19:
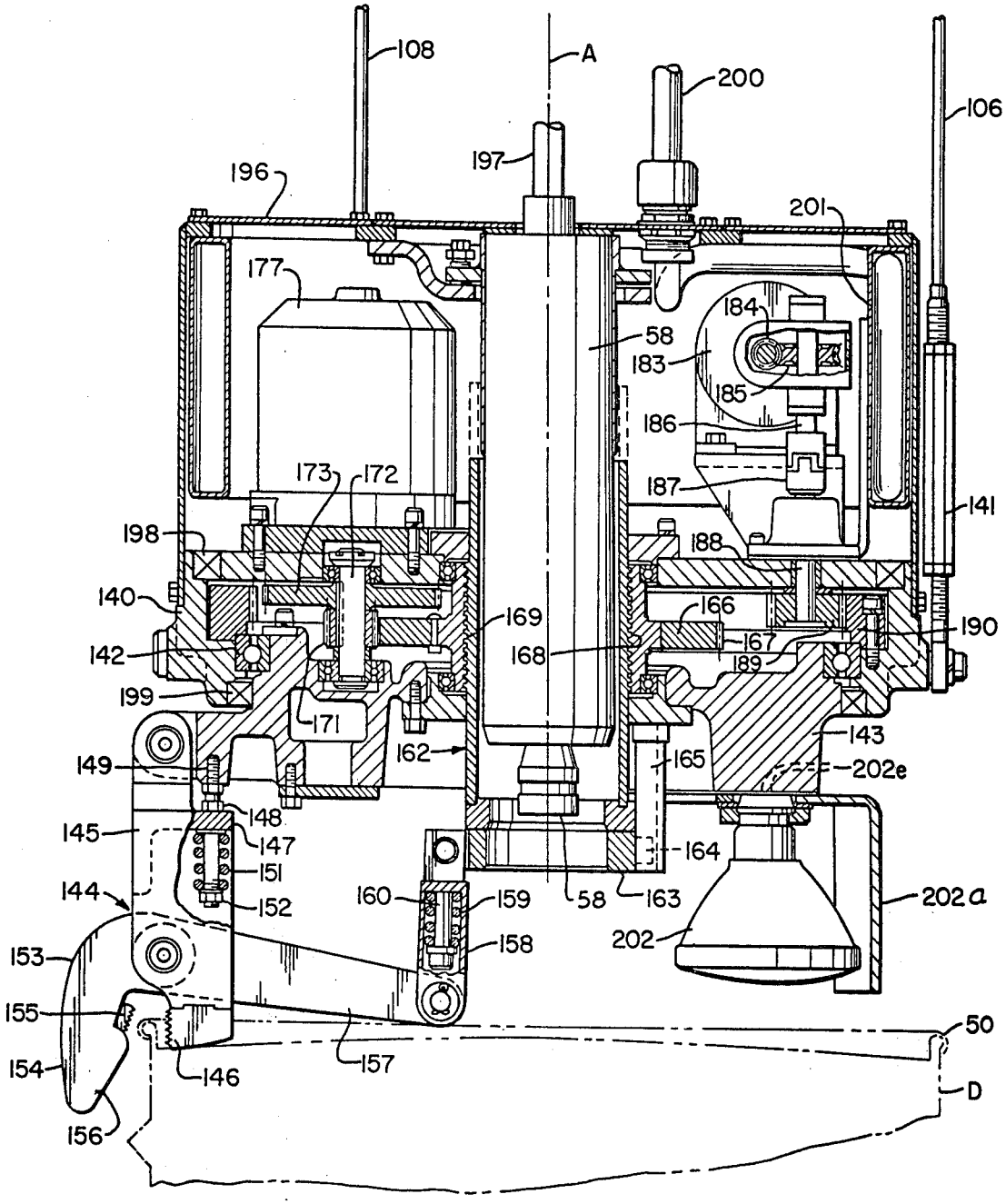
FIG. 19 is a section along line 19—19 of FIG. 18.
Figure 22:
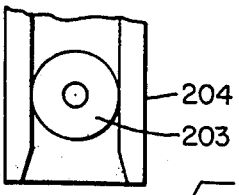
FIG. 22 is a detail along line 22—22 of FIG. 18 showing how guide members on the grab engage guide members on the trolley to locate the grab laterally relative to the trolley when it is in its uppermost position.
Figures 28, 29:
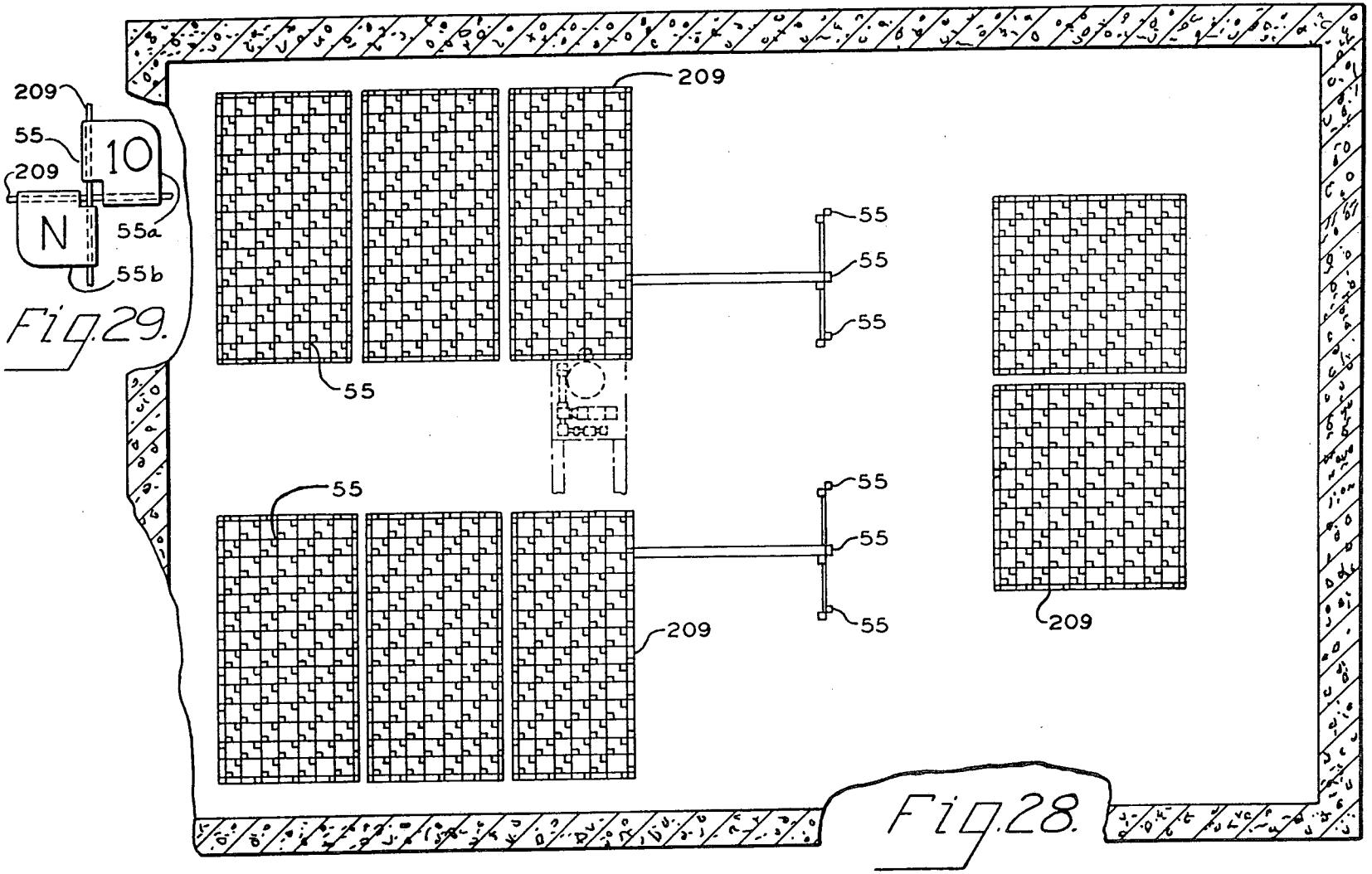
FIG. 28 is a view looking upwardly to show the indicating means that is viewed by the television screen on the trolley to locate the position of the trolley.
FIG. 29 is an enlarged detail showing one of the indicators of FIG. 28.

It is apparent from FIGS. 23–27 that the television camera 58 has, on or adjacent to its lens where it will show on the viewing screen 59, cross hairs 205 and markings 206, 207, 208, shown on the viewing screens illustrated in FIGS. 24–27. The centers on the cross hairs are located on axis A of the grab and the markings 206–208 indicate radial distances from the axis A. Consequently an operator at control station 14 viewing the monitor screen 59 connected to camera 58 can determine the distance of the grab from the top of a selected drum after the grab has been located over the drum. FIGS. 23–27 illustrate how an operator can determine the distance of the grab from drum D. Reference numeral **58*a* indicates television camera 58 and grab 53 at the farthest distance from the drum, and FIG. 24 illustrates the corresponding view of the drum as shown on screen 59. The next farthest camera and grab position is indicated by 58*b*, while FIG. 26 depicts the corresponding view on screen 59 in which drum D occupies almost the entire depth of the screen. The closest position of the camera and grab to drum D are indicated by 58*d* and the view on screen 59 is represented by FIG. 27 showing the outline of the cap opening structure C at the center of the top surface of the drum. When the cap opening structure C is of proper size on the screen to correspond with markings 207 at the camera lens, the operator knows that the grab is at the proper height and properly aligned with the axis of the drum to enable finger members 145 and 153 of the grab to be actuated to grasp properly the top edge of the drum as shown in FIGS. 8 and 9. When the grab is at the proper height as shown in FIG. 27 on screen 59, he reduces the lowering speed; as the fingers of the grab contact the top of the drum, the cables 106, 107, 108 become loose, allowing weighted pulleys 133, 134 to move down on the trolley and trip limit switch 136, which through known circuit means stops operation of the grab hoisting means 104. This limit switch also serves as an interlock to prevent the fingers of sets 144** from opening when the drum D is in hoisted position.

The trolley 52 and grab 53 can be readily properly located with reference to a drum to be picked up or deposited, by use of indicating means 54 (FIGS. 2, 3, 28, 29) that is viewed by the upwardly directed television camera 56 on the trolley. The means 54 illustrated comprises supporting frames 209 supported and extending near the ceiling of the building to support the location indicators 55 at predetermined locations, so they clear all parts of the crane apparatus. One indicator 55 is provided for each horizontal drum location. Indicators are therefore provided to locate all drums in each of the storage vaults, to locate a drum for each position in each drumming station where the crane is to handle a drum, and to locate all drums in the general storage location 8. Crossing frame portions 209 at each indicator provide a target for the camera 56. Indicators bear an accurate relationship to the center position desired for a drum. By suitable control from station 14, trolley 52 may be moved so an appropriate mark on or near the lens, and preferably at the center of the lens, of television camera 56 on the trolley is aligned with the target on the appropriate indicator 55 for the desired location. By suitable further control from station 14 of trolley 52 and grab 53 the grab can be lowered and caused to grasp the drum as previously described, and to be raised to lift the drum and lower it and release it in a desired location.

Preferably, each indicator 55 has two designations, one for a direction parallel to an X axis extending longitudinally of the building and one for a direction parallel to a Y axis extending across the building; in the embodiment illustrated (FIG. 29), each indicator 55 is made up of two portions **55*a* and 55*b* fixed to frame 209 at the proper location, portion 55*a* carrying a number designation and portion 55*b*** carrying letter designation.

The indicators 55 and hence the drums are located on centers a predetermined distance apart in the X and Y directions in the storage vault and in general storage area 8. The drums in the lowermost layer in the vaults and storage area are equidistantly spaced in the horizontal X and Y directions; the drums in the second layer are offset by half the distance between the centers of the drums in the first layer in the horizontal X and Y directions, so that each of the drums in the second layer is firmly supported by four drums below it in the lowermost layer; the drums in the third or top layer are also equidistantly located in the layer so that each drum is supported by four drums below it in the second layer and directly over a drum in the first layer. The indicators 55 on the indicating means 54 are properly located and identified to provide for this.

When drums are stacked in tiers as in the illustrated embodiment so that drums in a higher tier are directly over drums in a lower tier, it is desirable to have additional coded markings to indicate each location in which a drum may be directly over another, to alert the operator to watch the appropriate surveillance camera screen to check which tier of drums for which he is handling a drum; he could then watch the grab the grab elevation read-out in the control station to decelerate and halt the grab at the proper level.

Figure 5:
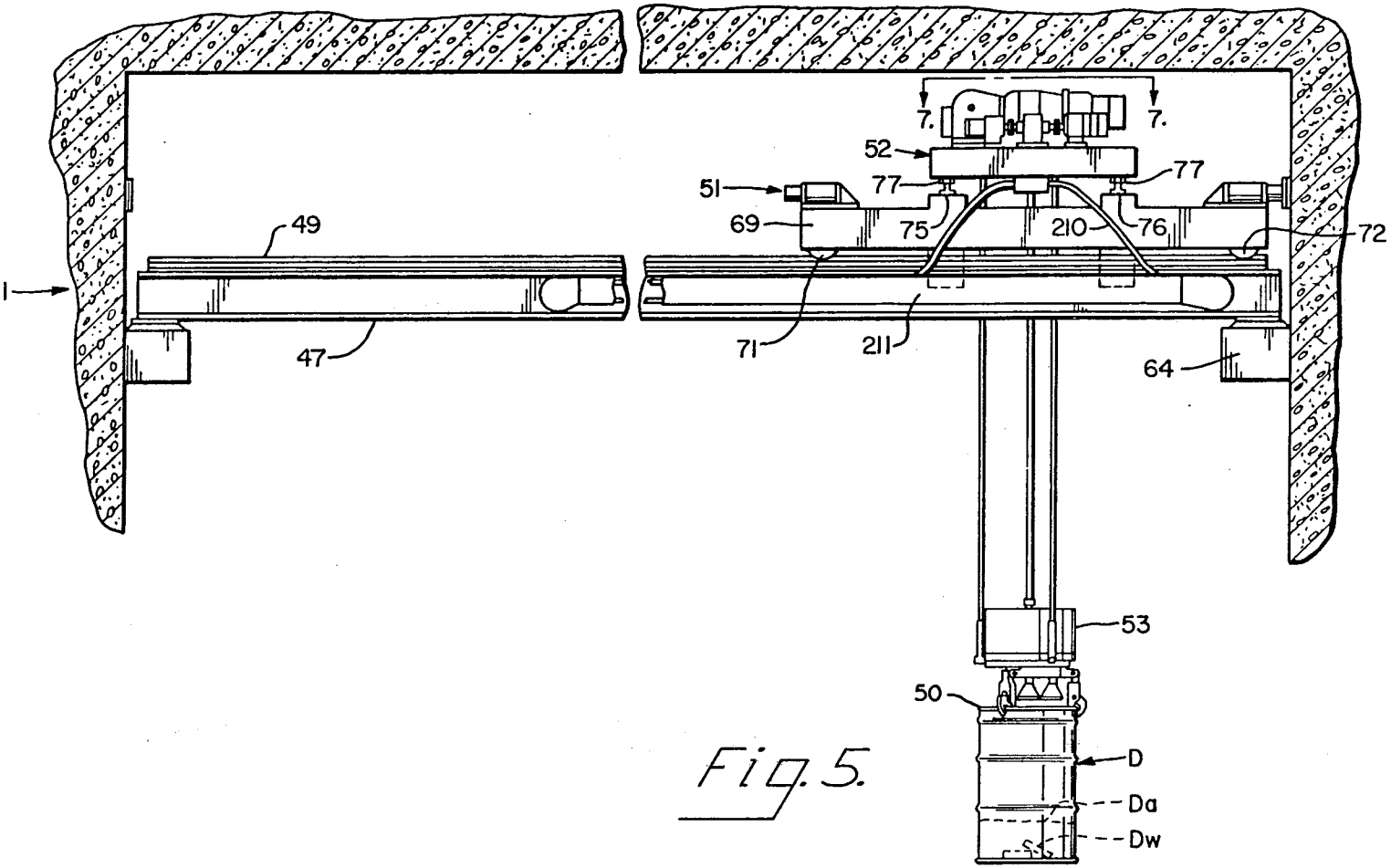
FIG. 5 is a section along line 5—5 of FIG. 4 and to the same scale showing the crane apparatus, portions of the apparatus of FIGS 1, 2 and 3 being broken away for the sake of clearness.
Figures 6, 13:
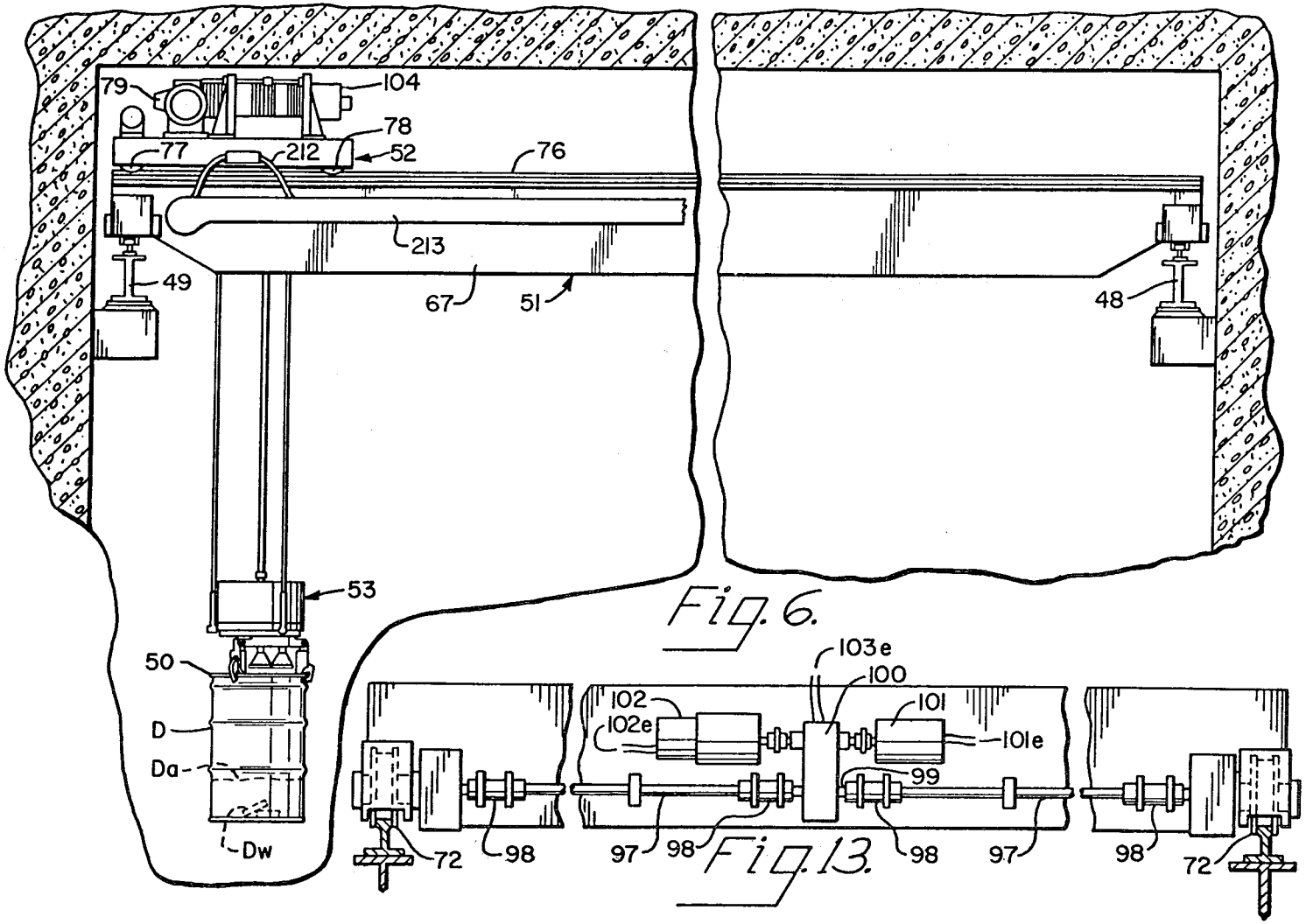
FIG. 6 is a sectional view along line 6—6 of FIG. 4.
FIG. 13 is a view to a smaller scale along line 13—13 of FIG. 4 showing the driving means for wheels of the bridge of the overhead crane apparatus, the trolley and other parts being omitted for clearness.

In the illustrated crane apparatus the various wires for transmitting electrical energy for power and control purposes are encased in cables, which are passed through means that compensate for changes in length of the cable due to movement of parts of the crane apparatus. Thus, as shown in FIG. 5, cable 210 passes through means 211 that compensates for changes in cable length as the bridge 51 passes along the track 47; and as shown in FIG. 6, cable 212 passes through means 213 that compensates for changes in the cable length as the trolley 52 travels on the bridge. The length compensating means 211 and 213 shown are like that disclosed in British Pat. No. 979,862 published Jan. 6, 1965, but other types may be employed. If desired, means may also be provided for the trolley to compensate for changes in length of cable between the trolley and grab.

Drumming Station: General Arrangement of Drumming Station

Each drumming station (FIGS. 1 and 2) has substantially identical apparatus; for convenience only the apparatus in drumming station 10 will be described, it being understood that the apparatus in the other drumming station is identical except for situations where parts may be of the other hand for convenience in installation or operation. Corresponding parts will have identical reference characters in both drumming stations.

The apparatus in each of the drumming stations 10 and 11 comprises substantially the same four basic components: a metal shield wall 214, drumming equipment 215, a decanting tank 216 and a set of metering pumps 217*a, b, c.*

Shield Wall

The shield wall 214 serves as a locating an anchoring means for the other components 215, 216, 217*a, b, c.* It is formed of strong metal to support the other components and to serve as a barrier to stop the escape of harmful radiation from the side of the shield wall carrying these components, to the other side. The shield wall may be of any of various thicknesses, depending on the intensity of radiation expected to be encountered. A shield wall of steel approximately 12 inches thick is advantageous for most uses of the invention.

The shield wall is rigidly but demountably attached to the concrete building wall 29 or 30 and preferably has a supporting eye 221 at its top. The shield wall can be demounted with the other components still attached, and bodily removed as by an overhead crane to a remote location for maintenance or repair.

Drumming Equipment

The drumming equipment 215 comprises a closed housing 226 supported from the side of the shield wall facing into the drumming station. The top of the housing has a hatch opening closed by a hinged hatch cover 234. The housing and hatch cover when closed provide an enclosure in which drum loading and mixing occurs. The hatch cover permits access to the enclosure for introduction or removal of drums, while preventing escape into the atmosphere of air displaced by materials loaded into the drum, and while preventing escape of radioactive material due to splashing should the drum being processed develop a leak or should material be accidentally spilled during the loading operation.

A fixed loading dock 241 is externally mounted at one side of the housing 226 and is adapted to support a drum to be filled that is first deposited by the crane on this dock. A fixed unloading dock 242 is externally mounted on the other side of housing 226; a drum removed from housing 226 is set by the crane on this unloading dock, and the intensity of radiation emanation from the drum is measured by known radiation monitor means that sends by known means electrical signals to the control station 14 where the information is noted. Each of the loading and unloading docks carries a scale connected with known means for reporting the scale reading to the control station. The scales are adapted to be removed from and placed on their supporting stations by the grab, so if necessary the scales can be serviced in a radiation free area.

A typical cycle of operations of the drumming station is described in -detail in said co-pending application Ser. No. 182,088. Assuming the parts of the unit 215 are prepared to receive a drum in the vertical position; the hatch cover 234 is open; and a capped drum D containing cement and mixing weights Dw is on the loading dock 241, the operator in control station 14 controls the overhead crane 25 and its drum grab 53 to pick up the drum from the loading dock and load it into the housing 226. The operator then causes the hatch cover to close and causes the drum to be gripped by the clamping members of the unit 215. The drum cap in then removed and the drum is supplied with a metered amount of a dispersion of radioactive particles in water from the decanting tank 216. The drum cap is then reinserted and screwed tight and the closed drum is next moved to a position for mixing. The drum is then rotated end-over-end to mix the drum contents thoroughly. When the mixing cycle has been completed, the mixer is stopped and the drum is located in an upright vertical position and unclamped.

Hatch cover 234 is then opened and drum grab 55 lowered through the hatch into the housing 226 to pick up the drum. The drum is then placed on the unloading dock 242 where its weight is checked by scale 244 and its radiation level is monitored by monitor 243 and the information transmitted electrically to control station 14 for recording.

Figure 30:
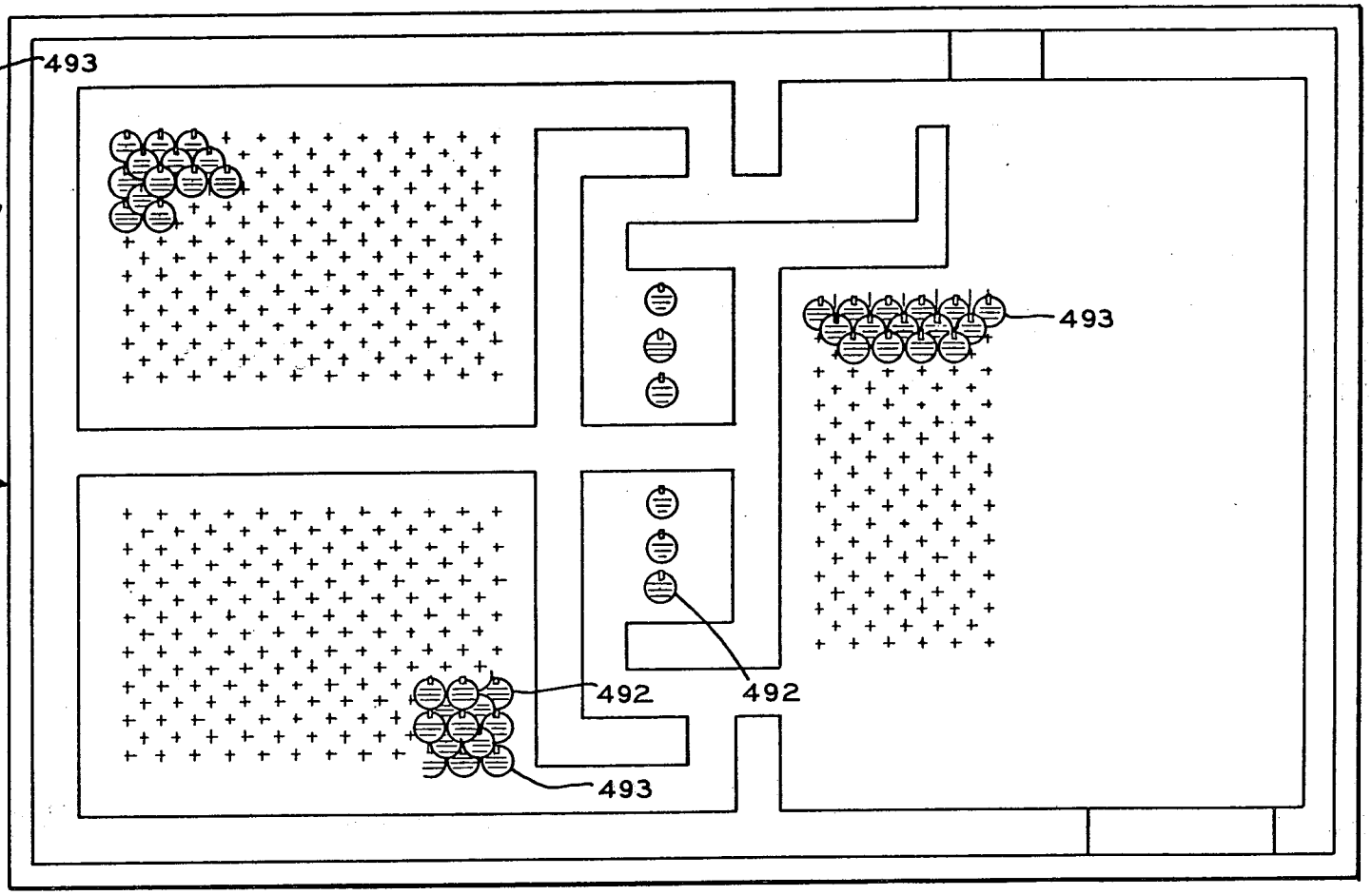
FIG. 30 is a face view of a record board for recording the locations of drums in the equipment.
Figure 31:
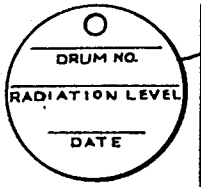
FIG. 31 is an enlarged view showing one of the tags that can be used on the record board to record information pertaining to a drum and its location.
Figure 32:
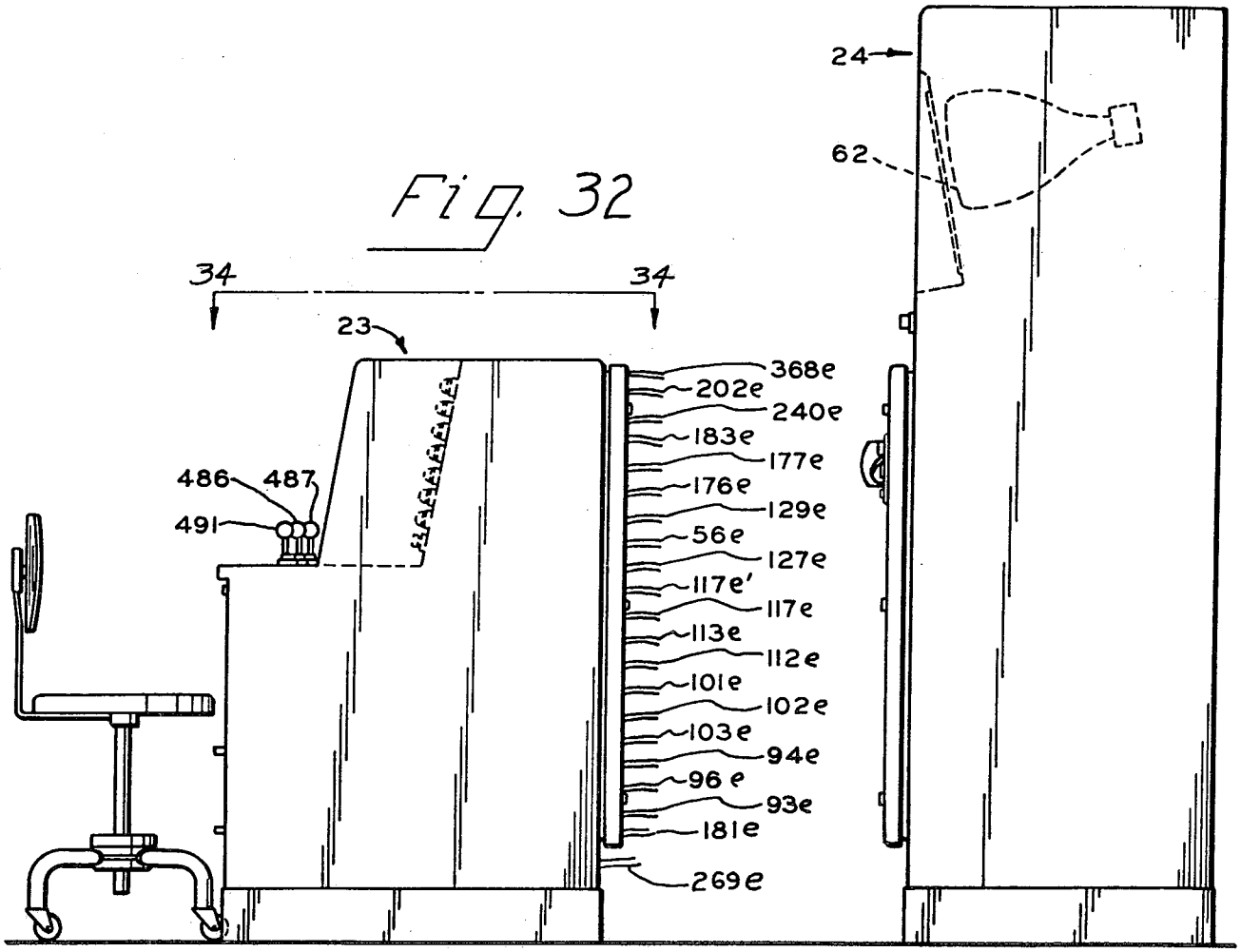
FIGS. 32 and 33 are side and front view of the control console equipment, shown in FIG. 1 in the control station, for controlling the apparatus, these Figures being to a larger scale than FIG. 1.
Figure 34:
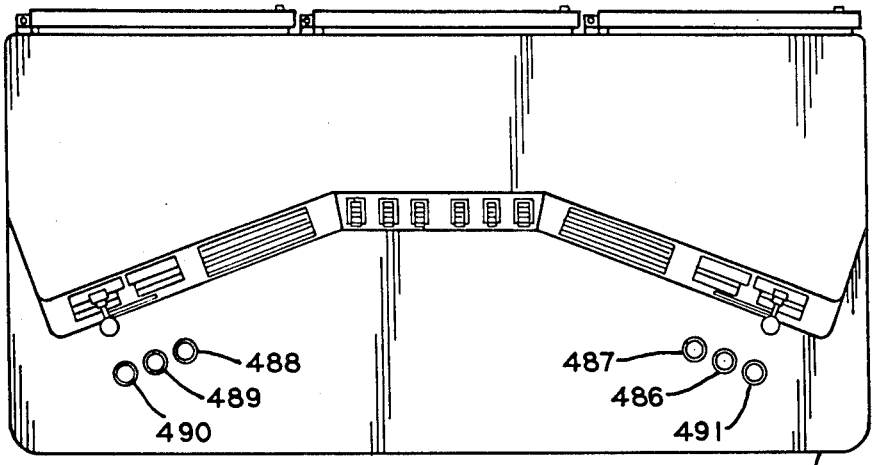
FIG. 34 is a plan from line 34—34 of FIG. 32.

The operator places another drum with its predetermined quantity of dry cement on the loading dock 241 as shown in FIG. 30 while the drum being filled is in housing 226 in its filling cycle. The scale 244 on the loading dock is used to verify the cement quantity in the drum, and the drumming apparatus is ready for the next cycle.

After the operator loads the next drum into the cradle and starts the drumming cycle, he then places the processed drum in one of the decay vaults 12, 13 for storage and brings another drum into position on the loading dock. Modifications may be made in this illustrative process of operations.

Control Station

Equipment in the control station 14 is shown in FIGS. 1, 32, 33 and 34.

The control station includes a control console 23 at which the operator will sit and from which he can control the operation of the apparatus by remote control. The control station also includes unit 24 spaced rearwardly from the control console and containing other apparatus and the television monitor screens 57, 59, 62 and 63, so that they are at a distance from the operator to avoid eyestrain.

As indicated previously, screen 57 is connected to the television camera 56 on the trolley and is used to locate the trolley with reference to the indicators 55 on the indicating means 54. As also indicated previously, screen 59 shows what is viewed by the camera 58 mounted on the grab 53 and particularly to indicate the distance of the grab from the tops of drums as indicated below. Television screens 62 and 63 are adapted to be connected to selected surveillance television cameras 60, 61, mounted on the bridge 51 of the overhead crane.

Switches 475 and 476 are used to select the surveillance cameras to be used and to tilt the selected surveillance television cameras, which may be of known types tiltable by remote control. The switches are of the type having control levers that if moved down will cause the camera to tilt downward and if moved up will cause the camera to tilt upward to a desired degree. The surveillance cameras may be provided with zoom lenses, and these can be controlled by switches associated with the switches 477 and 478.

Control console 23 is provided with camera control knobs 479 for properly focusing and controlling the cameras to provide a good image on the television monitor screens.

Figure 39:
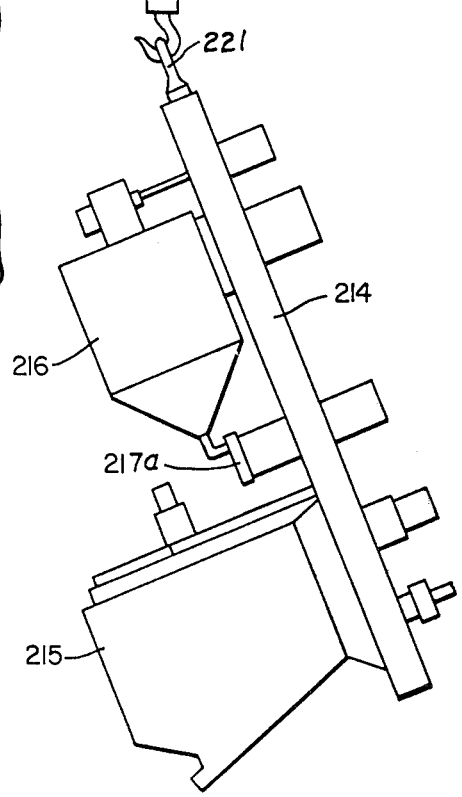
FIG. 39 is a plan of a modified form of trolley for the overhead crane apparatus, this trolley embodying a heavy duty hoist capable of lifting heavy portions of the apparatus, such as the shield wall or other equipment, out of or into the illustrated apparatus.

The control also has electronic counters 481 and 482, 483 and 484. Counters 481 and 482 are connected to the scales 244 in the drumming stations and used to record the weights of the drums as they go into the drumming stations and the weights of the drums as they come out of the drumming stations. Counters 483 and 484 indicate the grab elevation, and are actuated by the proximity switch 127 that counts the rotations of the winch drum 105. By this means the elevation of the grab can be determined without use of the lines on the grab camera screens, as when it is desired to determine or check the elevation of the grab in locations or at times other than when it is used to grasp a drum. Push buttons 485 and lights at the center of the console are used to control the various operations of the drumming station manually if desired as indicated above. Switch 486 is used to control the movement of the trolley on the bridge of the crane; switch 487 is used to move the bridge itself. A switch 488 is used to control the grab hoisting means 104 on trolley 52 to move the grab 53 up and down. Switch 489 is used to open and close the grab fingers, while switch 490 is used to control the rotation of the subframe 143 and grab fingers around axis A of the grab. A switch 491 is provided to control a heavy duty hoist if used (FIG. 39).

The switches 486 and 487 for moving the crane bridge and the trolley on the crane bridge are five position switches of known type operating in an "H" pattern, in which the fifth position is the neutral (off center position). When each of these switches is moved in the forward direction it will move the bridge of the trolley controlled by the switch in a given direction; when it is moved in the reverse direction it will move the bridge or trolley in the opposite direction. When the switch is moved to the left it will provide high speed control; when it is moved to the right it will provide low speed control. These switches are so designed that the switch must go through all positions so that there is no possibility of energizing a low speed motor when a high speed motor is energized, or the reverse situation.

The switches 488 and 489 used for controlling the raising and lowering of the grab and for controlling opening and closing of the grab fingers are similar.

A record board 65 (FIG. 30) showing the plan of the building and having hooks 492 for drum locations will be mounted in the control station at a location readily accessible to the operator. On these hooks, tags 493 illustrated in FIG. 49 will be hung. Each of these tags preferably is marked with a drum number identifying the drum, and has a place for the operator to mark the radiation level and the date. The operator thus can readily keep track of all of the locations and duration in storage of all drums that have been handled. For convenience only a portion of the hooks and tags are shown in FIG. 47, but a hook will be provided for each drum position, and tags will be used whereever a drum is located.

By a suitable drum log, it is also possible for the operator to keep a record of each drum to identify it by number, indicate its weight before filling with radioactive material and water, the weight after filling with radioactive material and water, the type of radioactive material, the start and completion time of the drumming operation, the radiation intensity of the drum immediately after it has left the drumming station, and the radiation intensity of the drum at the time of shipment, together with the date of shipment and the destination.

Lights 494 are preferably on the control box 24 to indicate that the crane circuitry in the drumming station circuitry is ready for operation. Control box 24 may also contain disconnecting switches to shut down the plant.

Additional Disclosures

It is apparent that various modifications may be made in the illustrated system, apparatuses and processes, and also that some or all portions of the illustrated apparatus may be used for purposes other than those indicated.

Figure 35:
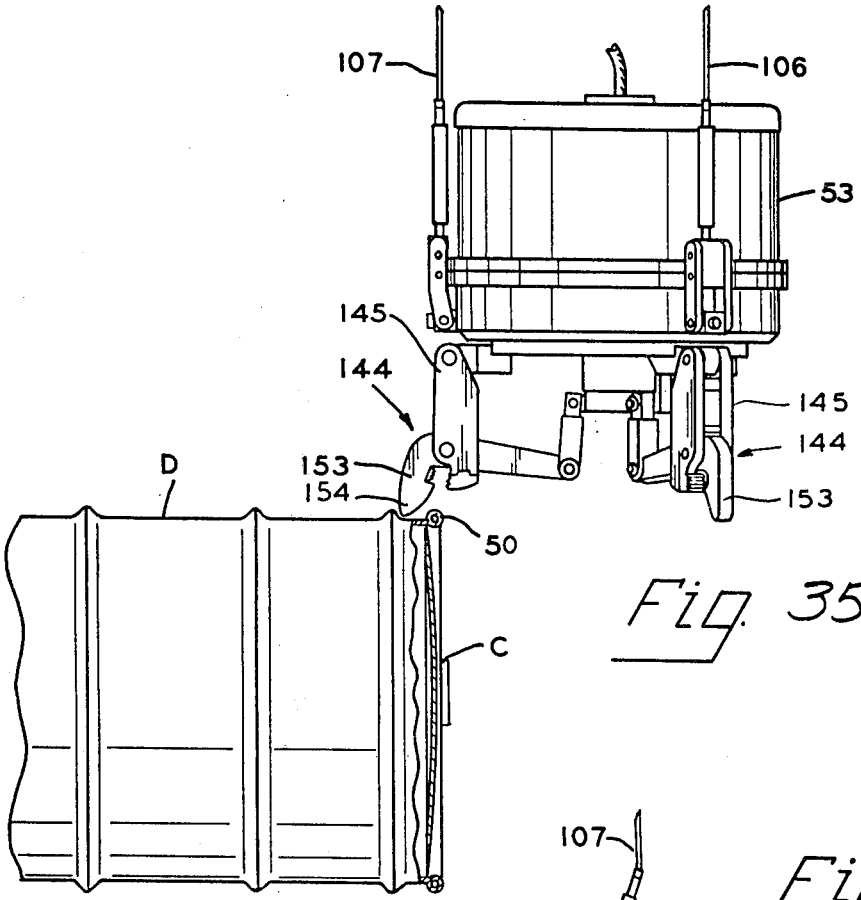
FIGS. 35 to 38, inclusive, are views showing how the grab of the illustrated crane apparatus can be used to grasp a drum even if it should be lying on its side rather than standing upright on its end.
Figure 36:
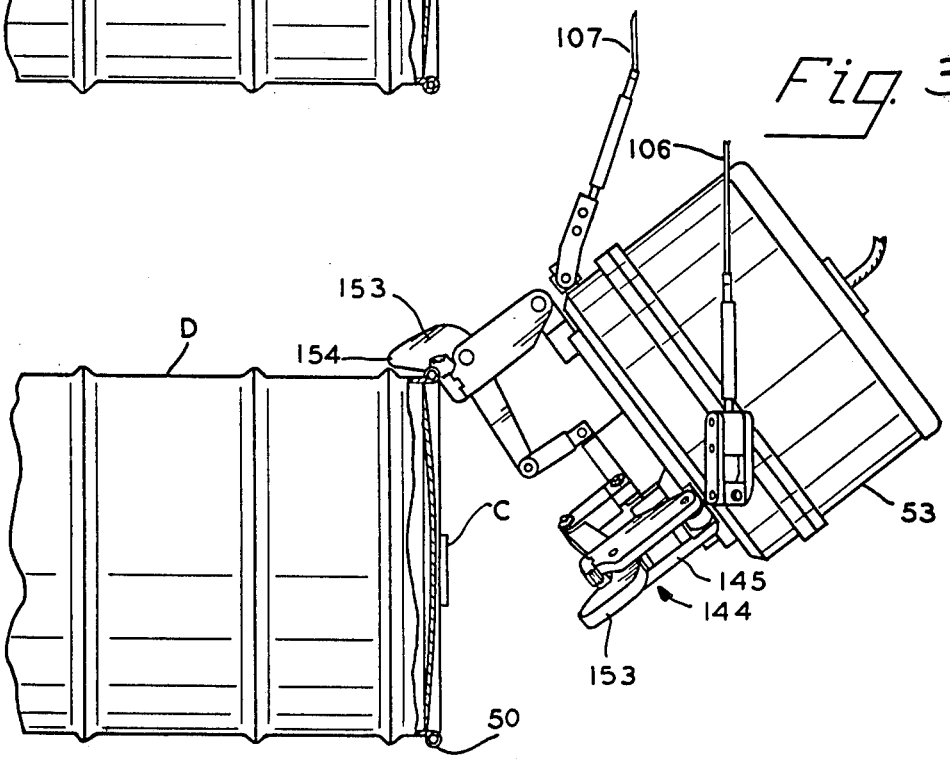
Figure 37:
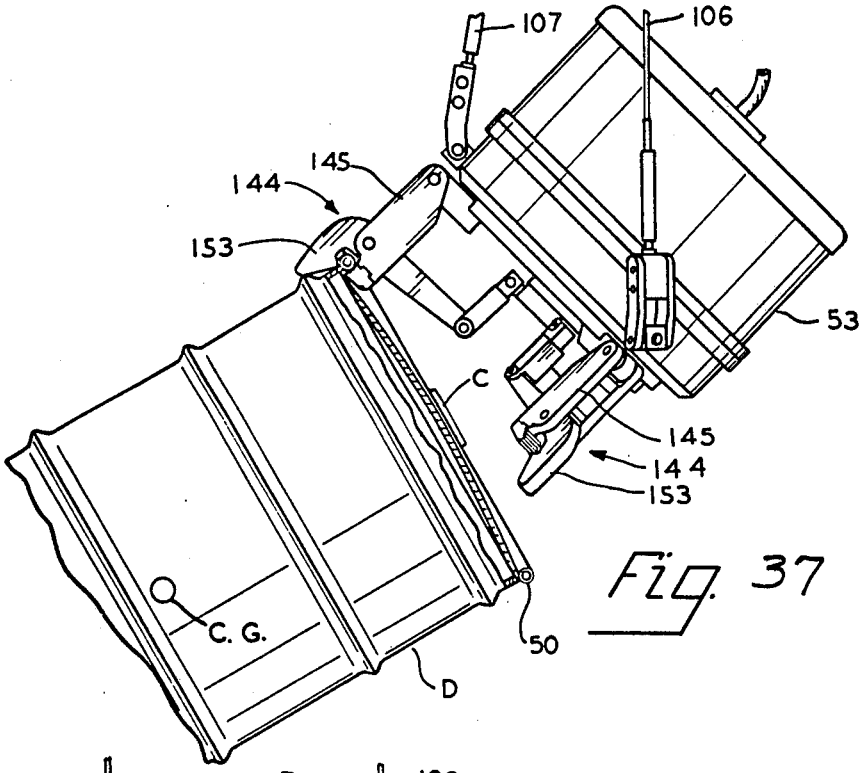
Figure 38:
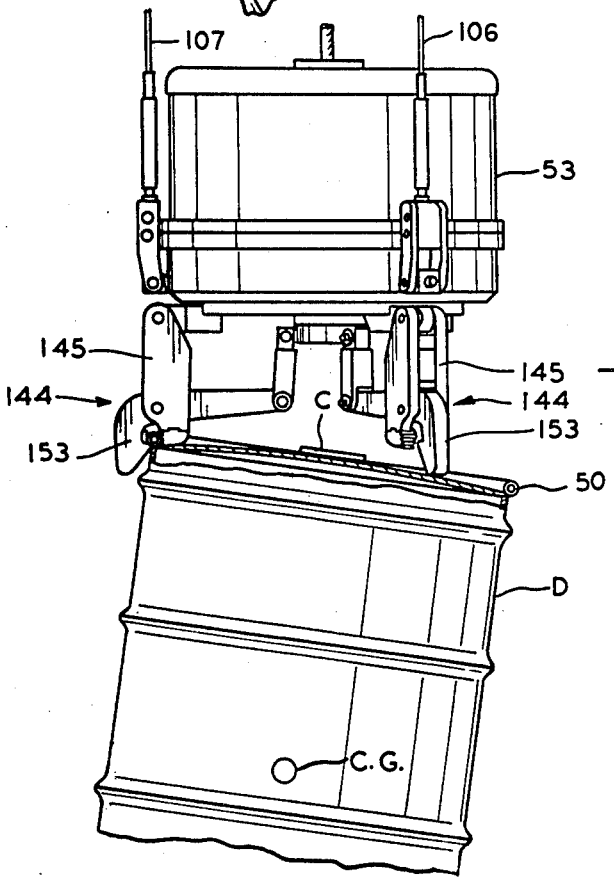

For example, it is possible that, in the course of operation, a drum containing radioactive material could be inadvertently caused to be in a horizontal or tilted position. Should the radiation be such that it would not be advisable for a person to approach the drum, the drum can be advantageously retrieved by the previously described drum grab 53, trolley 52, and crane bridge 51. FIGS. 35–38 illustrate a step-by-step procedure whereby this can be accomplished. The first step, illustrated in FIG. 35 is to align one of the grab support cables, in this illustrative case cable 106, with one of the grab finger sets 144. The grab is then aligned and lowered until the end portion 154 of finger member 153 contacts the top side of the drum adjacent its top edge 50 at its uppermost portion when the drum is on its side. The operator then (FIG. 36) continues to lower the grab 53 with the portion 154 of finger member 153 acting as pivot. The cable 107 is then slack and the grab is supported between finger member 153 and cables 106 and 108. When the view from the center of television camera 58 on screen 59 appears to be centered on a point midway between the drum closure portion C and the drum rim 50, the drum finger sets are actuated to cause the finger set contacting the drum edge 50 to grip it firmly. The grab is then raised as shown in FIG. 55, after the fingers have gripped the edge 56 to lift the drum toward a vertical position, FIG. 37. It is not necessary to lift the drum clear of the floor but only to a point where its center of gravity ("C.G.", FIGS. 37, 38) is located between the fingers gripping the drum and the lower edge of the drum resting on the floor. The grab is then lowered to allow the drum to settle to a normal upright position. Thereafter the grab can be controlled to grasp the drum normally by the three sets of fingers, and the drum can be hoisted and moved to and deposited at a desired location.

Figure 40:
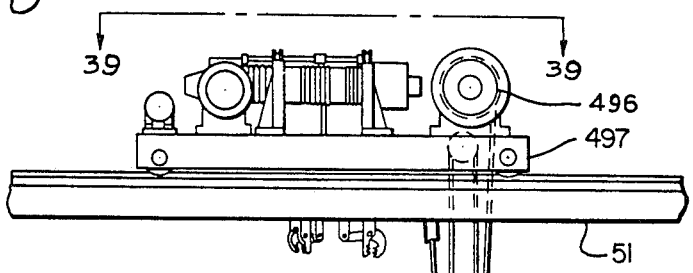
FIG. 40 is a side elevation showing the trolley of FIG. 39 as used in hoisting a shield wall and associqted equipment mounted on the shield wall.
Figure 40:
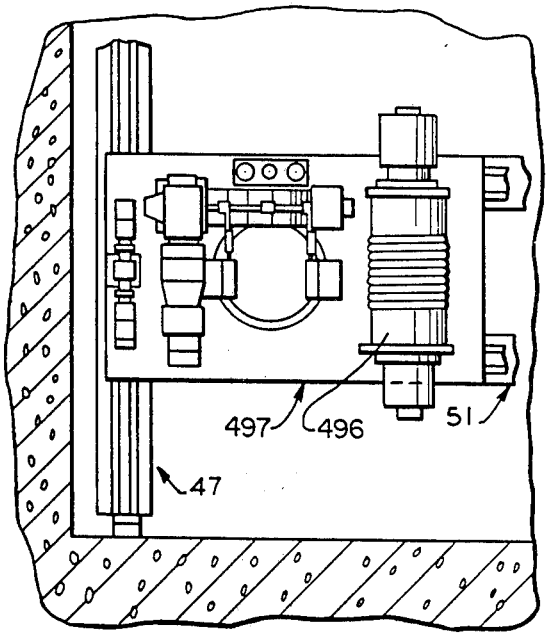

Another modification can be the addition of a second heavy duty hoist 496 constructed and powered by conventional means, to the crane trolley (FIGS. 39, 40). The trolley 497 shown in these figures is otherwise similar to trolley 52 previously described. Hoist 496 which would be controlled as indicated previously from the control station 14, makes it possible to move considerably heavier articles than could be lifted by the grab 53 and its hoisting apparatus. For example, this heavy duty hoist makes it possible to remove the entire shiedl wass 214 and all of the equipment mounted on it, including the decanting tank 216, drumming equipment 215, and pumps 217*a*, 217*b*, 217*c* and their drives from the drumming station to another area for maintenance, as shown in FIG. 40. Furthermore, if any part or all of the unit made up of the shield wall and its associated apparatus, should become unusuable due to radiation or other causes, it can be removed by the hoist for disposal as by burial. It is apparent that when such a heavy duty hoist adapted to carry a large load is provided, the crane bridge 51, the trolley 497, and the track structure 47 should be designed and made to support and carry the additional loads.

Furthermore, it is apparent that the overhead crane apparatus disclosed, in whole or in part or with modifications within the scope of the invention, may be used for purposes other than that disclosed; such other purposes may for example include the handling of other dangerous wastes or radioactive materials or bodies such as radioactive fuel elements.

From the above disclosure, it is apparent that the invention provides process and apparatus in which, by remote control, radioactive waste or other dangerous materials may be handled, put into containers which are sealed, and the contrainers handled and moved, without exposure of personnel to dangerous radioactivity or other dangers arising from the materials. Wherever necessary, all portions of the system are fail safe, so failure of electric supply or energy fluid such as pressurized air will not cause damage or unsafe conditions. All possible drives, fluid cylinders, controls, and switches are located in safe areas, usually on the safe side of a shield wall. All equipment for handling radioactive waste material can be moved from areas of high radiation to areas of little or no radiation. For these reasons routine as well as essentially all major maintenance or repair work can be done safely with little if any exposure of maintenance or other personnel to any radiation.

Wherever the metal shield wall 214 that carries the operative drumming apparatus is penetrated by a drive, the drive is by means of a rotating or reciprocating shaft in such a manner that the operation is accurately performed and escape of radiation is prevented; this makes for reliability and safety.

To insure that the apparatus performs satisfactorily with the utmost safety to personnel and the environment, the apparatus of the invention has a high degree of redundancy or dualism in drives, controls, viewing means, lights, and monitoring means. For example, the apparatus is designed to avoid completely any skills of radioactive material during placement of the radioactive material in the drums, closing the drums and rotating them. Also, the crane apparatus is provided with double drives and circuits for the bridge, trolley, grab hoisting means, and grab fingers, so if there is a failure of one drive of a double, the crane apparatus can be operated with the other drive.

All necessary lighting in areas exposed to radiation is provided on the crane apparatus on the trolley and grab, and the lights and lighting circuits are duplicated for safety and maintenance of operations; and if light fixtures or bulbs or television cameras must be replaced or repaired, the movable crane portions can be moved to radiation free areas for such purpose. The only fixed lighting that need be supplied is in the control station 14, where it is in a radiation free area.

From the above, it is also apparent that grab and its finger sets and acuating mechanisms will work with out-of-round or out of size drums, or drums in which the tip head or gripping surface are not completely in a horizontal plane. Moreover, the grab can be used to grasp and move articles other than drums. If necessary or desired, other grab means than that disclosed can be used, particularly for grasping articles other than drums.

The television camera on the grab is preferably designed and located to view the fingers at least in their grasping relation so that the operator can be certain the fingers are in proper grasping position before hoisting; this provides a means in addition to the limit switch means previously described, for indicating the position and operability of the fingers.

These and other modifications may be made in the apparatus or process disclosed, and other modifications, advantages, and modes of operation will become apparent without departing from the spirit of the invention.

Having described our invention, we claim:

1. Grab means adapted to be raised and lowered by a crane or the like and adapted to grasp an object, comprising a frame adapted to be raised and lowered; means carried by said frame for grasping an object comprising at least one pair of pivotally connected clamping members adapted to grasp said object and comprising a first clamping member extending generally transversely of said frame and having a lower portion carrying a jaw portion and an upper portion pivotally supported from said frame, a second clamping member extending generally transversely from said frame and having a jaw portion adapted to cooperate with said jaw portion of said first clamping member to grasp said object, said second clamping member having an actuating portion pivotally supported from said frame, pivot means connecting said clamping members together to cause said jaw portions to move relatively toward each other when the actuating portion of said second clamping member moves in one direction relatively to said pivot means and to cause said jaw portions to move relatively away from each other when said actuating portion of said clamping member moves in the opposite direction relatively to said pivot means; and means associated with said frame for causing said actuating portion of said second clamping member to move in opposite directions to cause said clamping members to move said jaw portions to move relatively toward and away from each other to grasp and release said object.

2. The apparatus of claim 1 comprising for each pair of clamping members a link member connecting said actuating protion of said second clamping member to movable means for positively moving said actuating portion in one direction, and resilient means associated with said link member for impositively moving said actuating portion in the opposite direction.

3. The apparatus of claim 1 in which said clamping members are adapted to grasp an object having upstanding flange means on the object, the jaw portion of said first clamping member engaging one side of said flange means and the jaw portion of said second clamping member engaging the other side of said flange means, and in which one of said clamping members has guide means that engages a side of said flange means to position said jaw portion relative to said flange means.

4. The apparatus of claim 1 in which said last-mentioned means causes said actuating portion of said second clamping member to move upwardly to cause said jaw portions to move relatively toward each other, and in which said last mentioned means also causes said actuating portion of said second clamping member to move downwardly to cause said jaw portions to move away from each other.

5. The apparatus of claim 1 in which said last-mentioned means moves said actuating portion of said second clamping member positively in one direction and impositively in the other direction.

6. The apparatus of claim 1 comprising means for indicating at a remote location the positions of said clamping members.

7. The apparatus of claim 1 comprising means for indicating at a remote location the operability of said clamping members.

8. The apparatus of claim 1 comprising a plurality of said pairs of said clamping members, and means for actuating them simultaneously to grasp or release an object.

9. The apparatus of claim 1 comprising means to indicate at a remote location the positions of said jaw portions of said pair of clamping members.

* * * * *